US008020251B2

(12) United States Patent
Luebbering et al.

(10) Patent No.: US 8,020,251 B2
(45) Date of Patent: Sep. 20, 2011

(54) VACUUM CLEANER WITH COLLAPSIBLE HANDLE

(75) Inventors: Gregory W. Luebbering, Heyworth, IL (US); Leonard Hampton, Normal, IL (US); Vincent Bobrosky, Normal, IL (US); Arnold Sepke, Hudson, IL (US); Jeffrey Smith, Bloomington, IL (US); Scott Bloom, Bloomington, IL (US); David A. Voigts, Normal, IL (US)

(73) Assignee: Electrolux Home Care Products, Inc., Cleveland, OH (US)

( * ) Notice: Subject to any disclaimer, the term of this patent is extended or adjusted under 35 U.S.C. 154(b) by 1617 days.

(21) Appl. No.: 11/333,226

(22) Filed: Jan. 18, 2006

(65) Prior Publication Data

US 2006/0156509 A1 Jul. 20, 2006

Related U.S. Application Data

(60) Provisional application No. 60/644,020, filed on Jan. 18, 2005, provisional application No. 60/673,359, filed on Apr. 21, 2005.

(51) Int. Cl.
*A47L 9/32* (2006.01)

(52) U.S. Cl. ..... 15/410

(58) Field of Classification Search ..... 15/410, 15/320, 334, 352, 282, 347
See application file for complete search history.

(56) References Cited

U.S. PATENT DOCUMENTS

| | | | |
|---|---|---|---|
| 1,507,271 | A | 9/1924 | Bennett |
| 1,656,031 | A | 1/1928 | Aalborg |
| 1,829,582 | A | 10/1931 | Carson |
| 2,330,621 | A | 9/1943 | Radke |
| 2,475,808 | A | 7/1949 | Storm, Jr. |
| 2,482,166 | A | 9/1949 | Gage |
| 2,484,491 | A | 10/1949 | Daugherty |

(Continued)

FOREIGN PATENT DOCUMENTS

| | | | |
|---|---|---|---|
| CN | 1463661 | A | 12/2003 |

(Continued)

OTHER PUBLICATIONS

Intensity Vacuum Cleaner [online], [retrieved on Feb. 27, 2007]. Retrieved from the internet <http://smallappliances.electroluxusa.com/node35.asp?ProdID=37007>.

(Continued)

*Primary Examiner* — Lee D Wilson
*Assistant Examiner* — Jamal Daniel
(74) *Attorney, Agent, or Firm* — Hunton & Williams

(57) ABSTRACT

A vacuum cleaner having a base adapted to be moved on a surface to be cleaned, an inlet nozzle disposed on a lower surface of the base, a vacuum source, and a dirt receptacle. A lower handle is pivotally attached to the base at a lower pivot, and an upper handle is pivotally attached to the lower handle at an upper pivot. In one aspect, the vacuum cleaner includes an automatically-operated lower pivot lock that can restrict relative rotation between the lower handle and the base, and a manually-operated upper pivot lock that can restrict relative rotation between the upper handle and the lower handle. In another aspect, the vacuum cleaner includes a telescoping upper handle with electrical controls attached to the upper telescopic section of the upper handle. In still another aspect, the vacuum cleaner includes an exhaust vent located on an upwardly-facing surface of the base.

22 Claims, 14 Drawing Sheets

U.S. PATENT DOCUMENTS 2,524,117 A 10/1950 Storm, Jr.
2,613,007 A * 10/1952 Von Hofe ..... 156/282
2,618,007 A * 11/1952 Fuller ..... 15/347
3,148,400 A 9/1964 Worwag
3,203,707 A 8/1965 Anderson
3,204,272 A 9/1965 Greene et al.
3,277,512 A 10/1966 Waters
3,357,716 A 12/1967 Musichuk
3,460,188 A 8/1969 Boyd
3,485,017 A 12/1969 Duran et al.
3,527,469 A 9/1970 Gobin
3,618,158 A 11/1971 Worwag
3,631,559 A 1/1972 Gaudry et al.
3,673,628 A 7/1972 Gaudry et al.
3,855,763 A 12/1974 Seifert et al.
3,950,817 A 4/1976 McKaig
4,071,920 A 2/1978 Block
4,071,922 A 2/1978 Davies, III et al.
4,245,371 A * 1/1981 Satterfield ..... 15/320
4,519,113 A 5/1985 Hipple
4,660,246 A 4/1987 Duncan et al.
4,662,026 A 5/1987 Sumerau et al.
4,670,937 A 6/1987 Sumerau et al.
D294,988 S 3/1988 Goodrich
4,763,382 A 8/1988 Sumerau
RE32,751 E 9/1988 Joss et al.
D310,438 S 9/1990 Burns
5,046,761 A 9/1991 Cordes
5,247,719 A 9/1993 Wareham et al.
5,261,215 A 11/1993 Hartz et al.
5,319,828 A 6/1994 Waldhauser et al.
5,326,116 A 7/1994 Flax
5,330,037 A 7/1994 Wang
5,332,266 A 7/1994 Canale
5,500,979 A 3/1996 Worwag
5,513,415 A 5/1996 Kent et al.
5,513,418 A 5/1996 Weber
D371,654 S 7/1996 WoRwag
D374,017 S 9/1996 Chunn et al.
5,636,504 A 6/1997 Kaley et al.
D384,083 S 9/1997 Hinklin
5,664,285 A 9/1997 Melito et al.
5,671,499 A 9/1997 Melito et al.
5,699,586 A 12/1997 Melito et al.
D394,526 S 5/1998 Strandell
5,765,250 A 6/1998 Lee
5,765,258 A * 6/1998 Melito et al. ..... 15/352
5,829,090 A 11/1998 Melito et al.
5,864,921 A 2/1999 Chou
5,941,575 A 8/1999 Herbst
5,996,175 A * 12/1999 Fusco ..... 15/410
6,006,402 A 12/1999 Maurer et al.
6,012,200 A 1/2000 Murphy et al.
6,029,313 A 2/2000 O'Dea et al.
D428,677 S 7/2000 Saunders et al.
6,101,671 A 8/2000 Wright et al.
6,108,862 A 8/2000 Frederick et al.
6,145,159 A 11/2000 Zahuranec et al.
D437,666 S 2/2001 Park
6,209,168 B1 4/2001 Brickner et al.
D443,121 S 5/2001 Hamm et al.
6,237,189 B1 5/2001 Maurer et al.
6,311,366 B1 11/2001 Sepke et al.
6,317,920 B1 * 11/2001 Brickner et al. ..... 15/334
D453,404 S 2/2002 Farone et al.
D453,597 S 2/2002 Zahuranec et al.
6,345,411 B1 2/2002 Kato et al.
6,363,571 B1 * 4/2002 Block et al. ..... 15/335
D456,961 S 5/2002 Ng
6,401,294 B2 6/2002 Kasper
6,406,505 B1 6/2002 Oh et al.
D460,973 S 7/2002 Jong
6,412,141 B2 7/2002 Kasper et al.
6,474,696 B1 11/2002 Canale
6,564,423 B2 5/2003 Sergyeyenko et al.
6,574,831 B2 6/2003 Hunter et al.
6,581,241 B2 6/2003 Shaver et al.
6,631,535 B2 10/2003 Sergyeyenko et al.
6,766,559 B2 7/2004 Roney et al.
6,779,229 B2 8/2004 Lee et al.
6,785,932 B2 9/2004 Bone
6,817,059 B2 * 11/2004 Tsuchiya et al. ..... 15/352
6,941,615 B2 9/2005 Shanor et al.
D522,200 S 5/2006 Scheifele et al.
D533,699 S 12/2006 Dyson et al.
7,159,271 B2 * 1/2007 Sepke et al. ..... 15/320
7,219,390 B2 * 5/2007 Johnson et al. ..... 15/410
7,281,298 B2 * 10/2007 Joung et al. ..... 15/410
7,373,690 B2 * 5/2008 Sepke et al. ..... 15/410
2004/0206238 A1 10/2004 Allgeier
2004/0250376 A1 12/2004 Hori et al.
2005/0060837 A1 * 3/2005 Johnson et al. ..... 15/410
2005/0066470 A1 3/2005 Yoshida
2005/0091783 A1 5/2005 Sepke et al.
2005/0125944 A1 6/2005 Ji
2005/0210626 A1 9/2005 Joung et al.
2005/0283939 A1 12/2005 Theiss, Jr. et al.
2006/0101606 A1 5/2006 Gordon et al.
2006/0156509 A1 7/2006 Luebbering et al.
2008/0244860 A1 * 10/2008 Gammack et al. ..... 15/410

FOREIGN PATENT DOCUMENTS

DE 398849 7/1924
DE 19630286 1/1998
EP 1407703 9/2003
GB 877778 9/1961
GB 2318279 4/1998
GB 2408922 6/2005
JP 2-299627 12/1990
WO WO 2006/078580 7/2006

OTHER PUBLICATIONS

Photographs of Eureka Model 210 (6 pages).

* cited by examiner 1434
1428
1426
1432
1423
1422
102
1420
1427
1425
1414
1430
1416
1424
1408
1412
1406
1404
1410
1418
1340
1332
1302
1326
1322
1330
1402
1358
1104
1320
1306
1312

VACUUM CLEANER WITH COLLAPSIBLE HANDLE

CLAIM OF PRIORITY

This patent claims priority to U.S. Provisional Application Nos. 60/644,020, filed on Jan. 18, 2005, and 60/673,359, filed on Apr. 21, 2005, each of which is incorporated herein by reference in its entirety.

FIELD OF THE INVENTION

The present invention relates generally to floor cleaning devices having collapsible handles.

BACKGROUND OF THE INVENTION

Electric vacuum cleaners are in widespread use in homes, offices and other places where quick and efficient floor cleaning is desired. Such vacuum cleaners are provided in various configurations, such as upright, canister, "stick," and "powerhead" designs.

Upright vacuums are typically provided having a relatively large floor-engaging, wheeled nozzle base to which a pivoting rear housing/handle is attached. The base includes a suction nozzle directed towards the floor, and the rear housing includes a dirt storage receptacle (such as a cyclonic or non-cyclonic dirt separation chamber or a vacuum bag chamber), and a grip for manipulating the device. A vacuum fan and motor assembly (fan/motor) is located in either the base or the rear housing to provide a suction airflow that either draws air through the nozzle and dirt receptacle, or draws air into the nozzle and pushes it through the dirt receptacle. The base may also include an agitator driven by either the fan/motor, a separate motor, or an air turbine. Upright vacuums are also known to include a flexible hose and various cleaning tools for cleaning above the floor or in hard to reach areas.

Canister vacuums operate in the same manner as uprights with respect to generating a working air flow and separating dirt, but typically include a floor-cleaning nozzle base that is attached to a canister by way of a flexible vacuum hose. Like an upright, the nozzle base has a nozzle directed towards the floor, and may include an agitator driven by a motor in the base. The canister contains the fan/motor and dirt receptacle (again, of a bag, cyclonic or non-cyclonic bagless design).

Stick vacuums are, essentially, compact upright vacuums in which the size of the nozzle base has been minimized. These vacuums typically have a relatively small base, which may or may not have an agitator disposed in or near the air inlet. The fan/motor and dirt receptacle are typically located in a stacked arrangement in a narrow rear housing to provide the device with a slender, easily-stored profile. It can generally be said that stick vacuums are designed to locate as many of the working parts as possible in the rear housing, and in as compact a manner as practicable. Stick vacuums often use battery power, but some are corded.

Powerhead-type vacuums are the opposite of stick vacuums in that they are typically designed to locate most or all of the working parts in the nozzle base, and minimize the number of size of any parts that are located in the rear housing/handle. However, such vacuums often share the stick vacuum objective of being smaller or more compact than typical uprights and canisters. Examples of powerhead vacuums include those in U.S. Pat. Nos. 6,574,831; 6,317,920; 6,012,200; 5,829,090; 5,500,979; 5,319,828; 4,519,113; 3,618,158; and 1,829,582, all of which are incorporated herein by reference. In such devices, the nozzle base typically houses the nozzle, dirt receptacle and fan/motor, and may also include an agitator and an agitator motor (if it is not driven by the fan/motor). It is also known to power such devices using conventional electrical cords or batteries, which may be located in the base or the rear housing/handle. The rear housing includes a hand grip and serves the primary (and often the only) function of being a handle with which to guide the nozzle base. However, in some cases the rear housing has been provided with accessory tool storage areas, or has been adapted to serve as an accessory vacuum hose or wand.

While the known powerhead-type vacuum cleaners have been somewhat successful, there still exists a need to provide an improved powerhead-type vacuum cleaner.

SUMMARY OF THE INVENTION

In a first aspect, the present invention provides a vacuum cleaner having a base adapted to be moved on a surface to be cleaned, an inlet nozzle disposed on a lower surface of the base, a vacuum source operatively associated with the vacuum cleaner and adapted to draw a working airflow into the inlet nozzle, and a dirt receptacle operatively associated with the vacuum cleaner and adapted to remove dirt from the working airflow. A lower handle is pivotally attached to the base at a lower pivot, and an upper handle is pivotally attached to the lower handle at an upper pivot. The vacuum cleaner includes an automatically-operated lower pivot lock having a first position in which it restricts relative rotation between the lower handle and the base, and a second position in which it does not restrict relative rotation between the lower handle and the base. The vacuum cleaner also has a manually-operated upper pivot lock having a first position in which it restricts relative rotation between the upper handle and the lower handle, and a second position in which it does not restrict relative rotation between the upper handle and the lower handle.

In another aspect, the present invention provides a vacuum cleaner having a base adapted to be moved on a surface to be cleaned, an inlet nozzle disposed on a lower surface of the base, a dirt receptacle mounted in the base and in fluid communication with the vacuum inlet, and a vacuum source mounted in the base and adapted to generate a working flow of air into the vacuum inlet and through the dirt receptacle. The vacuum cleaner has a handle pivotally attached to the base. The handle includes a lower handle pivotally attached to the base at a lower pivot, and an upper handle pivotally attached to the lower handle at an upper pivot. The upper handle includes a lower section, an upper section telescopically mated to the lower section, and an adjustment mechanism adapted to selectively allow and prevent telescopic movement between the upper section and the lower section. The vacuum cleaner also has at least one electrical control attached to the upper section of the upper handle, and adapted to control at least one electrical device in the base.

In still another aspect, the present invention provides a vacuum cleaner having a base adapted to be moved on a surface to be cleaned, an inlet nozzle disposed on a lower surface of the base, a dirt receptacle mounted in the base and in fluid communication with the vacuum inlet, and a vacuum source mounted in the base and adapted to generate a working flow of air into the vacuum inlet and through the dirt receptacle. A handle is pivotally attached to the base. The handle includes a lower handle pivotally attached to the base at a lower pivot, and an upper handle pivotally attached to the lower handle at an upper pivot. The vacuum cleaner also includes an exhaust vent in fluid communication with and downstream of the dirt receptacle and the vacuum source. The exhaust vent is located on an upwardly-facing surface of the base.

Other embodiments, features and variations are also included within the scope of the invention.

DETAILED DESCRIPTION OF THE PREFERRED EMBODIMENTS

The present invention generally provides a unique vacuum cleaner having a collapsible handle. While the embodiments described herein and illustrated in the accompanying figures are depicted as a vacuum cleaner, it will be understood that the invention can also be practiced as a wet or dry extractor, or as other types of special-purpose vacuum cleaners. As used herein, the expressions "vacuum cleaner" and "vacuum" are intended to include any cleaning device that uses a suction source to remove dirt or other undesirable substances from surfaces, regardless of whether it includes specialty features, such as a fluid deposition system and fluid recovery tank (as in wet extractors), and regardless of what type of dirt separation system it uses (such as cyclonic, bag, or dirt cup separation systems). These and other variations will be apparent to those of ordinary skill in the art in view of the present disclosure.

Figure 1A:
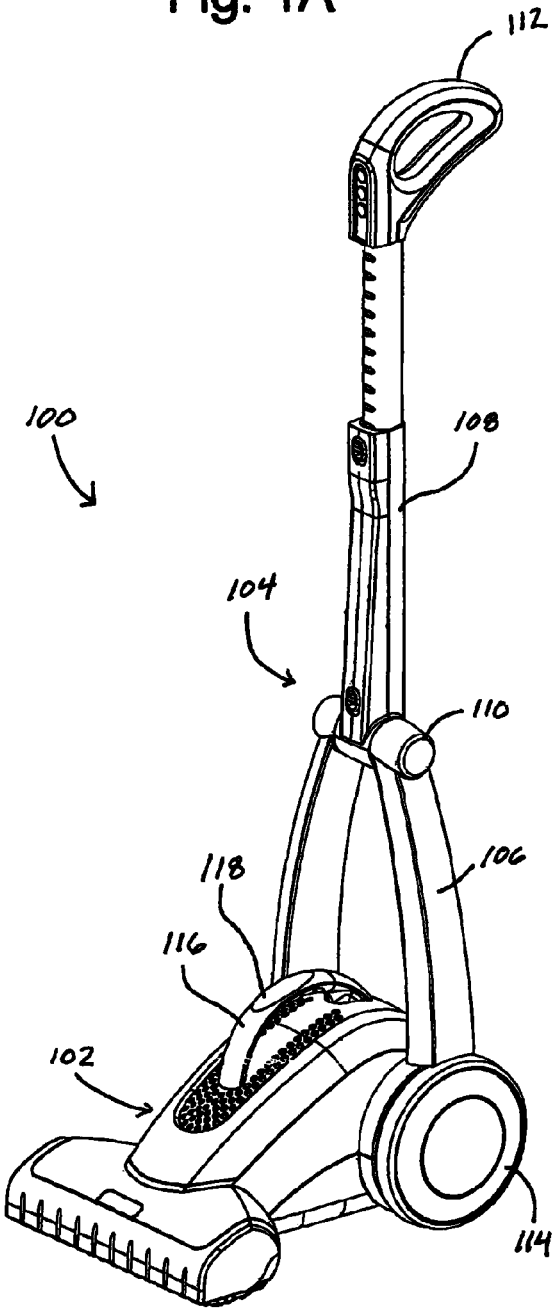
FIG. 1A is a perspective drawing of an embodiment of the invention, shown with the handle unfolded and telescopically extended.
Figure 1B:
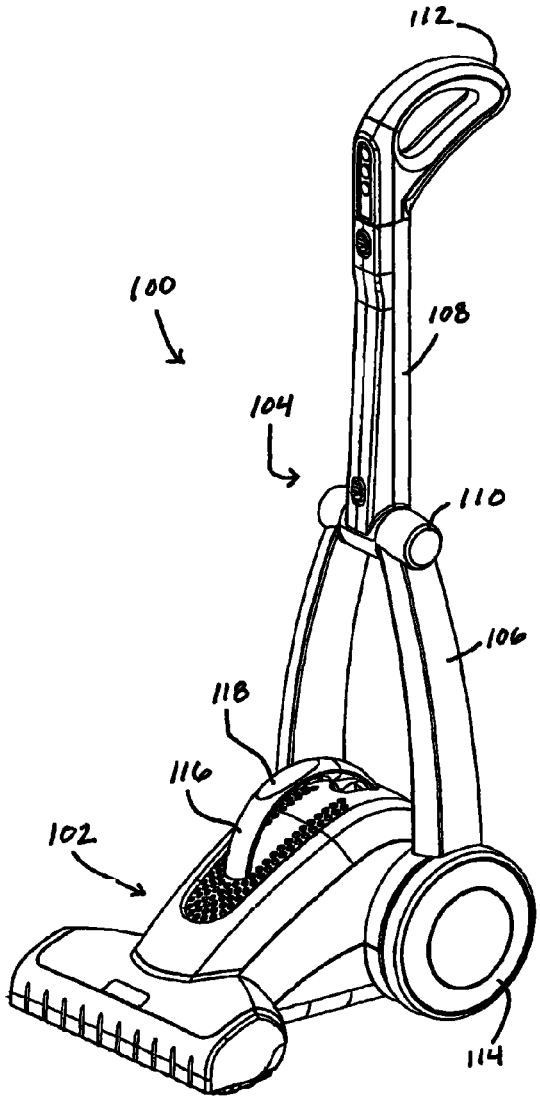
FIG. 1B is a perspective drawing of the embodiment of FIG. 1A, shown with the handle unfolded and telescopically contracted.
Figure 2:
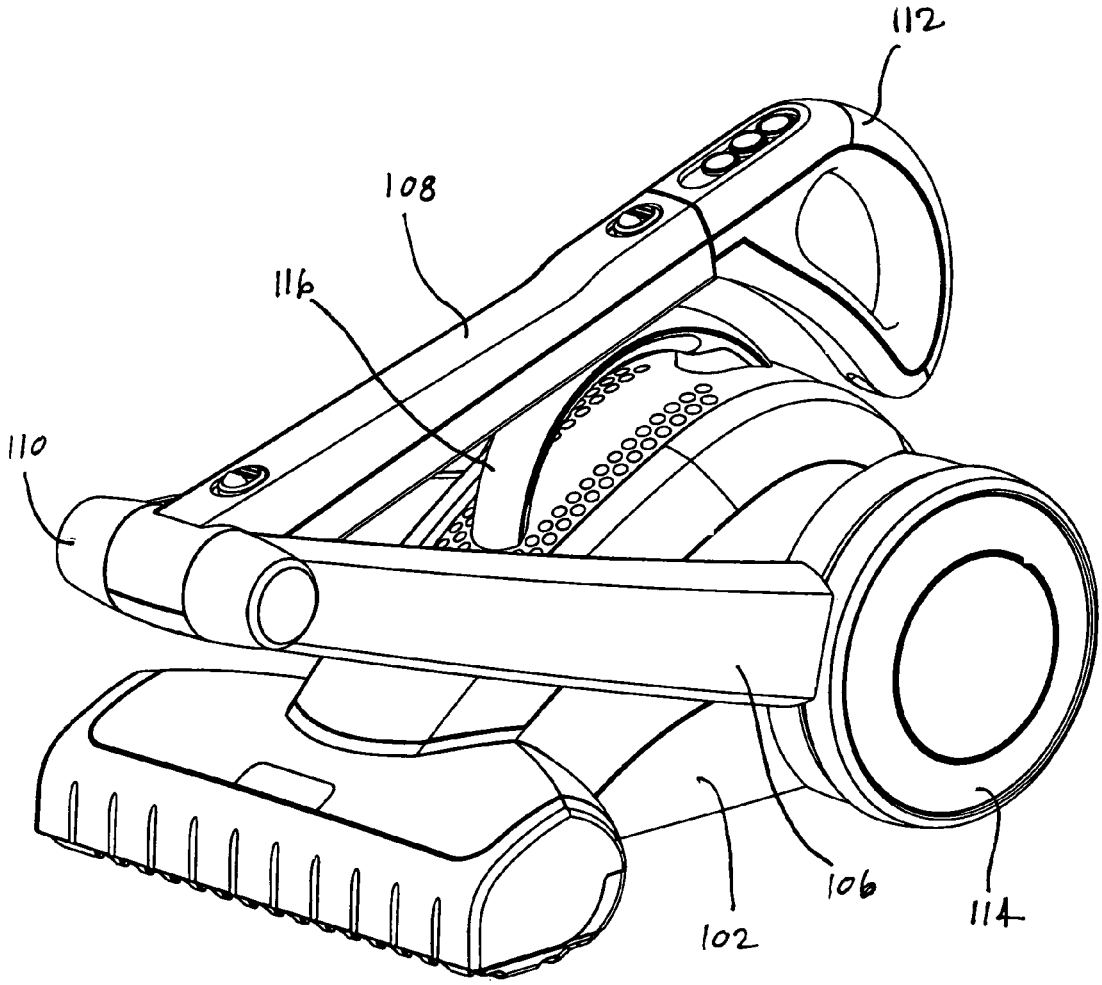
FIG. 2 is a perspective drawing of the embodiment of FIG. 1A, shown with the handle folded.

Referring now to FIGS. 1A, 1B and 2, an embodiment of the invention comprises a vacuum cleaner 100 having a floor-contacting base 102 and a collapsible handle 104. The base 102 and handle 104 are generally configured as a powerhead type vacuum cleaner, in which the vacuum fan, motor, air inlet and dirt receptacle are all located in the base 102, but this is not strictly required, and various operating parts, such as the vacuum source and dirt separation system, may be located in the handle 104.

The handle 104 comprises a lower handle 106 and an upper handle 108, which are joined to one another at a mid-handle joint 110. A grip 112 is provided at the top of the upper handle 108, and shaped to provide ergonomic control of the device. As shown in this embodiment, the lower handle 106 comprises a yoke having two uprights. This construction has been found to be particularly useful because the bifurcated lower handle 106 can be pivoted forward to straddle the base 102, providing a very compact folded assembly. In this embodiment, the upper handle 108 pivots backwards, and rests on or next to a carrying handle 116 on the base 102. Preferably, the upper handle rests in a groove 118 located along the top of the carrying handle 116. In this embodiment, the carrying handle 116 is remains functional to move the vacuum cleaner 100, even when the handle 104 is folded, and the vacuum cleaner 100 may even be operational in this position. A lock (not shown) may be provided on the carrying handle 116 or upper handle 108 to lock the two together to prevent inadvertent unfolding.

While the foregoing yoke and post arrangement for the lower and upper handles 106, 108 is preferred, it is also envisioned that the lower handle 106 could be replaced with a single post pivotally attached along, or offset from, the longitudinal centerline of the base 102. In such an embodiment, a compact folded shape may still be obtained, for example, by shaping the base 102 with notches or troughs into which the upper and/or lower handles fit. The upper handle may also deviate from the shown single post construction.

The mid-handle joint 110 joins the upper and lower handles 108, 106, and can lock the lower and upper handles 106, 108 together into an unfolded position, as shown in FIGS. 1A and 1B, and allow the lower and upper handles 106, 108 to fold, as shown in FIG. 2. In the unfolded position, the upper and lower handles 108, 106 are generally co-linearly aligned, and locked together so that the handle 104 operates as a single rigid member. In the folded position, the device can be stored in a relatively small space, and may even be constructed to operate in this manner. The mid-handle joint 110 may also have other lock positions. For example, it may have a lock position in which the upper handle 108 is held in its folded position (FIG. 2) relative to the lower handle 106. The upper handle pivot lock may also have a lock position in which it holds the upper handle 108 such that it is tilted forward relative to the lower handle 106 (i.e., pivoted in a direction opposite to the direction shown in FIG. 2), which may be useful to operate the device under low furniture by allowing the lower handle 106 to lie flat behind the base 102 with the upper handle 108 raised from the floor surface.

The lower end of the lower handle 106 is pivotally attached to the base 102. This pivotal attachment preferably is on an axis concentric with the rotational axis of a pair of rear base wheels 114, but other attachment points and axes or rotation are also possible. A lower pivot lock 1374 (FIG. 13), holds the lower handle 106 in an upright resting position, as shown in FIGS. 1A and 1B, but can be released to allow the lower handle 106 to freely rotate in at least the backwards direction with respect to the base 102 to allow the vacuum cleaner 100 to be operated in a conventional manner. The lower pivot lock 1374 may also include other locking positions, such as one in which the lower handle 106 is held in the forward folded position as shown in FIG. 2, to prevent if from accidentally unfolding when it is lifted.

Figure 3:
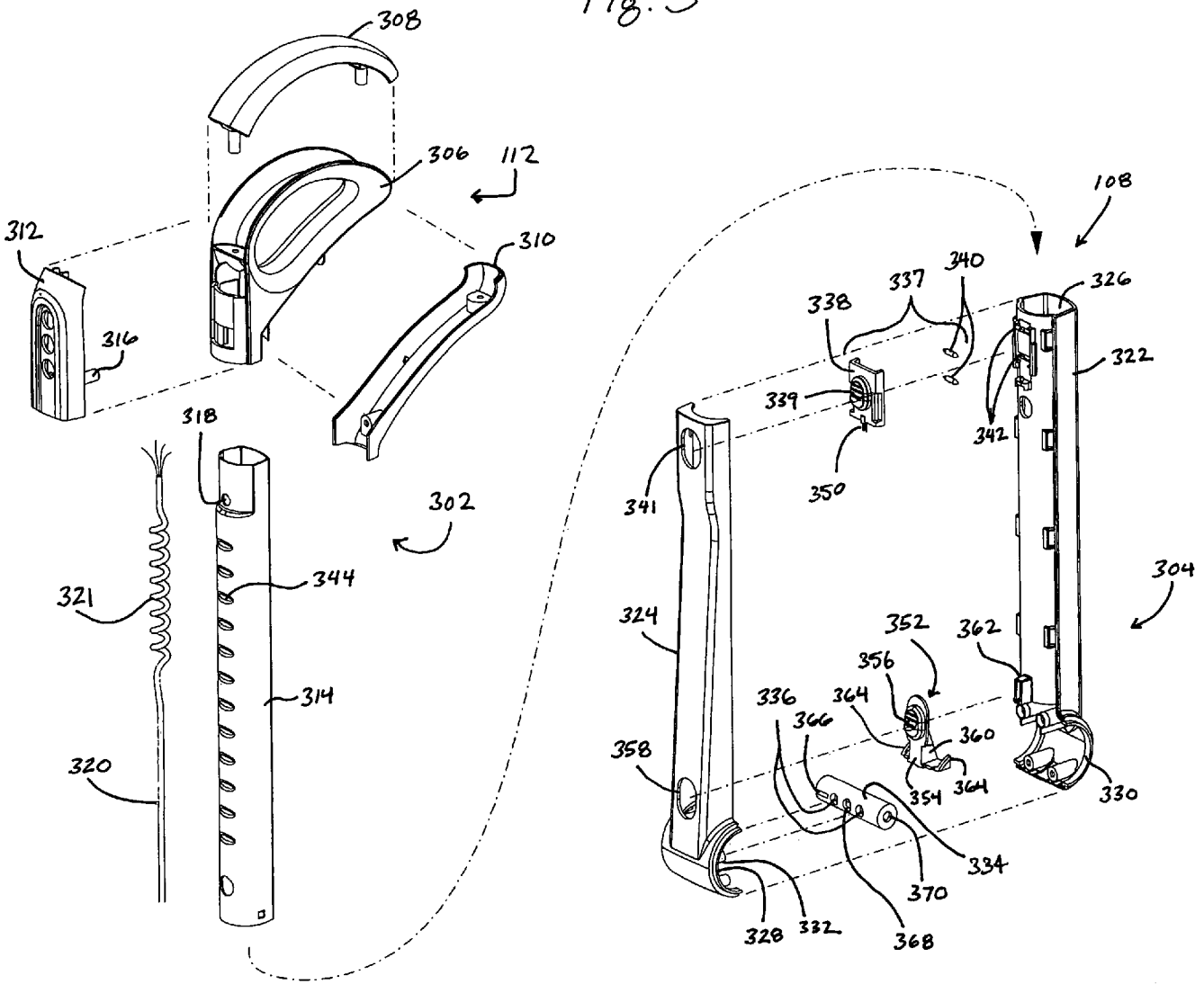
FIG. 3 is an exploded perspective drawing of the upper handle assembly of the embodiment of FIG. 1A.

Referring now more specifically to FIG. 3 an embodiment of an upper handle 108 is described in detail. A preferred upper handle 108 includes an upper telescoping portion 302 and a lower telescoping portion 304 that are slidably attached to one another to allow the upper handle 108 to be lengthened and shortened to suit the operator's preferences.

The grip 112 is attached to one end of a telescoping tube 314 to form the upper telescoping portion 302. The grip 112 includes a main grip housing 306, an upper grip housing 308, a lower grip housing 310, and a control plate 312. The grip 112 may include one or more overmolded surfaces or textured surfaces to enhance the user's feel on the grip 112. In the shown embodiment, the main grip housing 306 slides over the end of the tube 314, and is held in place by a screw boss 316 that extends rearwardly from the control plate 312 into a corresponding hole 318 in the tube 314. A screw (not shown) is inserted through the lower grip housing 310 and engaged with the screw boss 316 to hold the parts together. In addition, the tube 314 has a non-circular profile that engages with a correspondingly-shaped opening in the bottom of the of the main grip housing 306 so that the grip 112 and tube 314 can not rotate relative to one another.

The control plate 312 includes any buttons, switches or other controls that are desired for operating the device. In a preferred embodiment, these controls include a first button that turns on a vacuum fan motor, a second button that turns on both the vacuum fan motor and a brushroll motor, and a third button that turns the fan motor and brushroll motor off. Pressing the any of the buttons overrides the other buttons, so, for example, if the user has pressed the second button to activate the fan and brushroll motors, but subsequently presses the first button, then the brushroll motor will turn off, and the fan motor will remain on. A control wire bundle 320 is attached these controls, and passes downward through the telescoping tube 314, with sufficient slack to allow it to remain attached even when the upper handle 108 is fully extended. The routing of the wire bundle 320 is discussed in greater detail herein.

The lower telescoping portion 304 of the upper handle 108 comprises a rear housing 322 and a front housing 324. The rear housing 322 has an internal sleeve 326 that is shaped and sized to slidingly receive the telescoping tube 314. Rotation between the tube 314 and rear housing 322 is prevented by using a pin and groove arrangement, by making the telescoping tube 314 and sleeve 326 with mating non-circular shapes, or by other known mechanisms. Examples of such arrangements are shown in U.S. Pat. Nos. 6,311,366 and 6,766,559, which are incorporated herein by reference. While the sleeve 326 is shown in the rear housing 322, it will be appreciated that it may instead be in the front housing 324, or otherwise formed therebetween.

Figure 7:
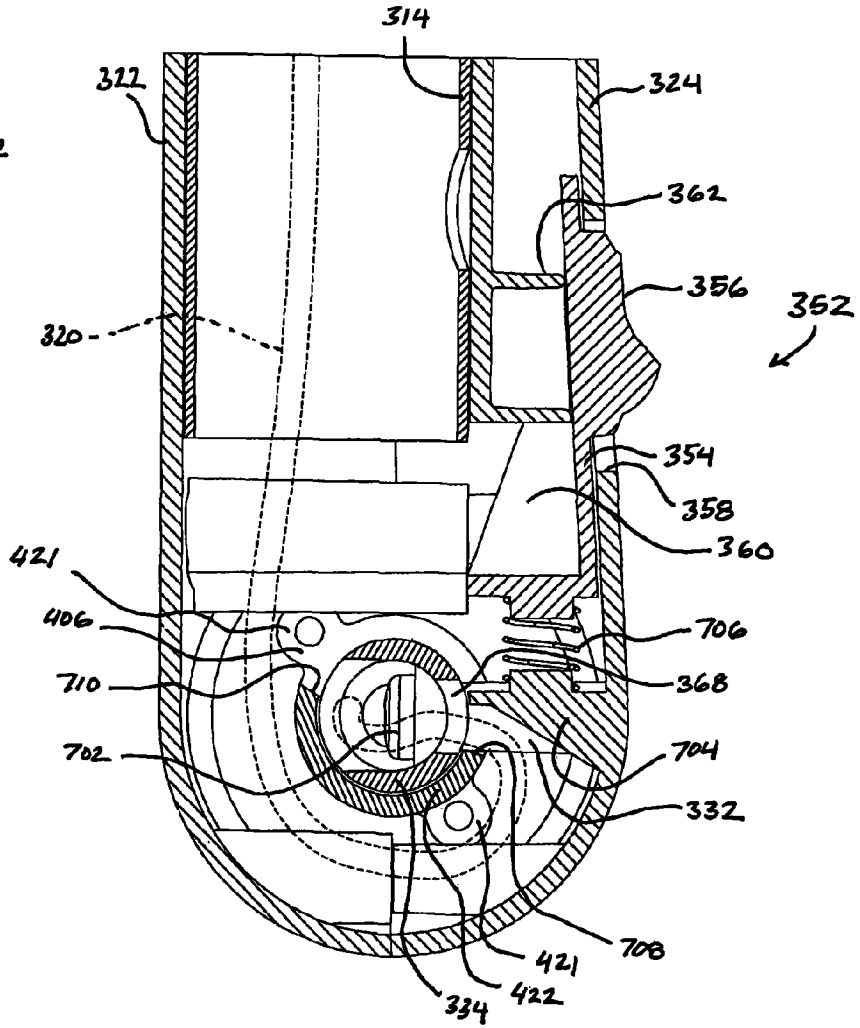
FIG. 7 is a fragmented cutaway view of the upper handle assembly of the embodiment of FIG. 1A, as shown from reference line VII-VII of FIG. 5.
Figure 8:
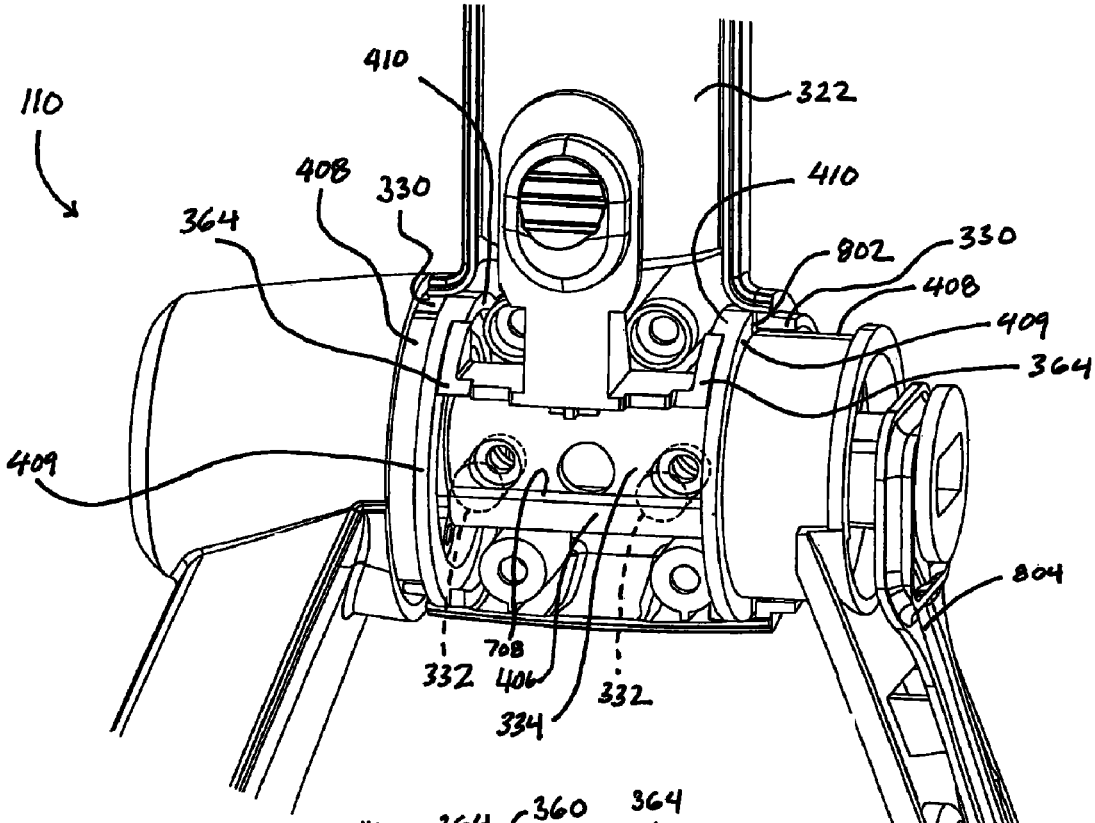
FIG. 8 is a fragmented, perspective view of the mid-handle joint of the embodiment of FIG. 1A, shown with various parts removed for clarity.
Figure 9:
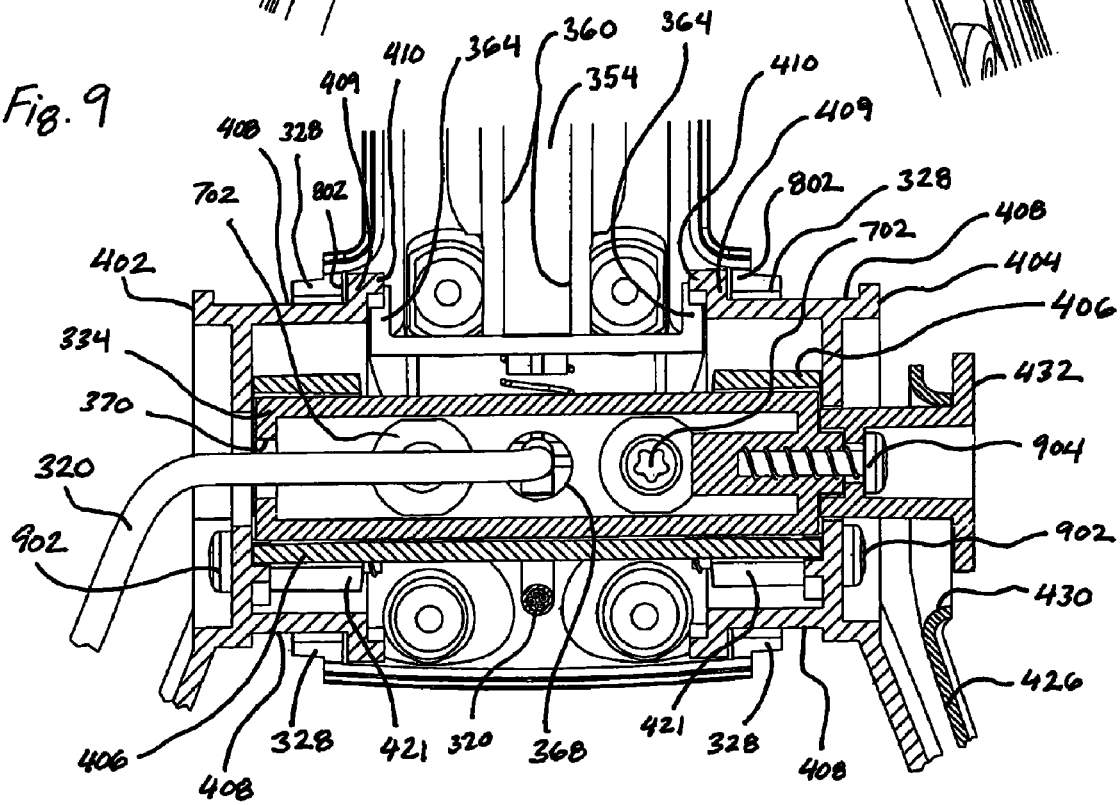
FIG. 9 is a rear cutaway view of the mid-handle joint of the embodiment of FIG. 1A.

The front and rear housings 324, 322 of the lower telescoping portion 304 include, at their bottom ends, complementary front and rear pivot surfaces 328, 330. When the front and rear housings 324, 322 are attached to one another, the pivot surfaces 328, 330 form a pair of circular rings, one on each side of the upper handle 108, that fit around corresponding cylindrical pivot surfaces 408 (FIG. 4) on the lower handle 106, as shown in FIGS. 8 and 9. In addition, the front housing 324 includes a pair or rearwardly-extending mounting bosses 332 (one of which is visible) to which an upper handle axle 334 is attached by press-fitment, screws, being captured in place, or the like. In a preferred embodiment, the upper handle axle 334 includes a pair of countersunk holes 336 into which the mounting bosses 332 fit, and screws 702 (FIG. 7) are passed through the back of upper handle axle 334 and into the mounting bosses 332 to hold the parts in place, as shown in FIGS. 7 and 9. The details of this assembly will be understood from consideration of FIGS. 3, 7, 8 and 9.

Figure 6:
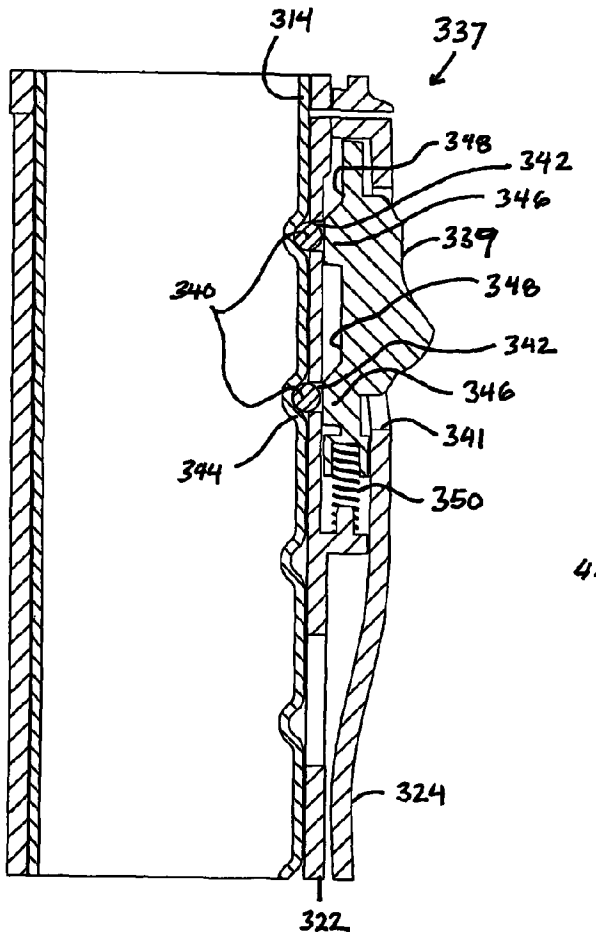
FIG. 6 is a fragmented cutaway view of the upper handle assembly of the embodiment of FIG. 1A, as shown from reference line VI-VI of FIG. 5.

Referring now to FIGS. 3 and 6, a telescoping lock 337 is provided to selectively prevent and allow the telescoping tube 314 to slide within the internal sleeve 326. In this preferred embodiment, the telescoping lock 337 includes a slider 338 that is captured in place between the front housing 324 and rear housing 322 such that it can slide up and down a short distance. The slider 338 has an operating button 339, which protrudes through a corresponding hole 341 through the front housing 324. The telescoping lock also includes a pair of rollers 340 that are captured in place in openings 342 in the rear housing 322. These openings 342 pass into the sleeve 326, and the rollers 340 are sized such that their cylindrical surfaces can protrude into the sleeve 326. However, extensions on the ends of the rollers 340 prevent them from passing through the openings 342 entirely and falling into the sleeve 326. When the telescoping tube 314 is inserted in the sleeve 326, the rollers 340 can fit into corresponding tube detents 344 on the telescoping tube 314. As shown in FIG. 3, a number of tube detents 344 are positioned along the length of the tube 314 to provide a variety of optional telescopic positions.

The back surface of the slider 338 includes a pair of protrusions 346 and a pair of slider detents 348, which are alternately located on the lock 338, and spaced apart by approximately the same distance as the space between the rollers 340. The slider 338 is movable between a locked position (shown) and an unlocked position. In the locked position, the protrusions 346 are adjacent the openings 342, and press the rollers 340 in to the openings 342 and into engagement with the tube detents 344. In this position, the engagement between the rollers 340, openings 342, and tube detents 344 prevents the telescoping tube 314 from moving relative to the internal sleeve 326. In the unlocked position, the slider 338 is moved until the slider detents 348 are adjacent the openings 342, which allows the rollers 340 to move into the slider detents 348 and out of engagement with the tube detents 344, thus allowing the tube 314 to slide within the sleeve 326. A spring 350 is provided to bias the slider 338 into the locked position.

While the foregoing embodiment is preferred, numerous variations are possible. For example, it may instead be desirable to only offer two telescopic positions, in which case tube detents 344 would be appropriately located to allow these positions. Also, the upper handle may use a lock that allows an unlimited number of different locking positions. The telescoping lock may also have any suitable alternative construction, such as those incorporated above or shown in U.S. Pat. Nos. 6,474,696, 5,941,575, 5,332,266, and 5,046,761, which are incorporated herein by reference. Still further, the upper handle 108 may instead be non-telescoping. In addition, while the upper and lower tubes are described as being "tubes," neither is required to be round or hollow. The tubes may instead comprise adjacent colinearly sliding parts, rather than concentric sliding parts. These and other variations will be understood by those of ordinary skill in the art, and are within the scope of the present invention.

Referring now to FIGS. 3 and 7, the upper handle 108 also includes a mid-handle joint lock 352. The mid-handle joint lock 352 comprises a slider 354 that is captured in place between the front housing 324 and rear housing 322 such that it can slide a short distance therein. The slider 354 includes an operating button 356 that protrudes through a corresponding hole 358 through the front housing 324. As shown in FIG. 7, the slider 354 has a pair of rearwardly-extending ribs 360 that fit around a corresponding protrusion 362 on the rear housing 322 to support and guide the slider 354. The front housing 324 includes a spring perch 704 located below the slider 354, and a spring 706 is positioned between the slider 354 and spring perch 704 to bias the slider upwards into its locked position. The slider 354 also includes a pair of teeth 364 located in a spaced relationship from one another. The purpose of these teeth 364 will become evident from the following discussion.

Figure 4:
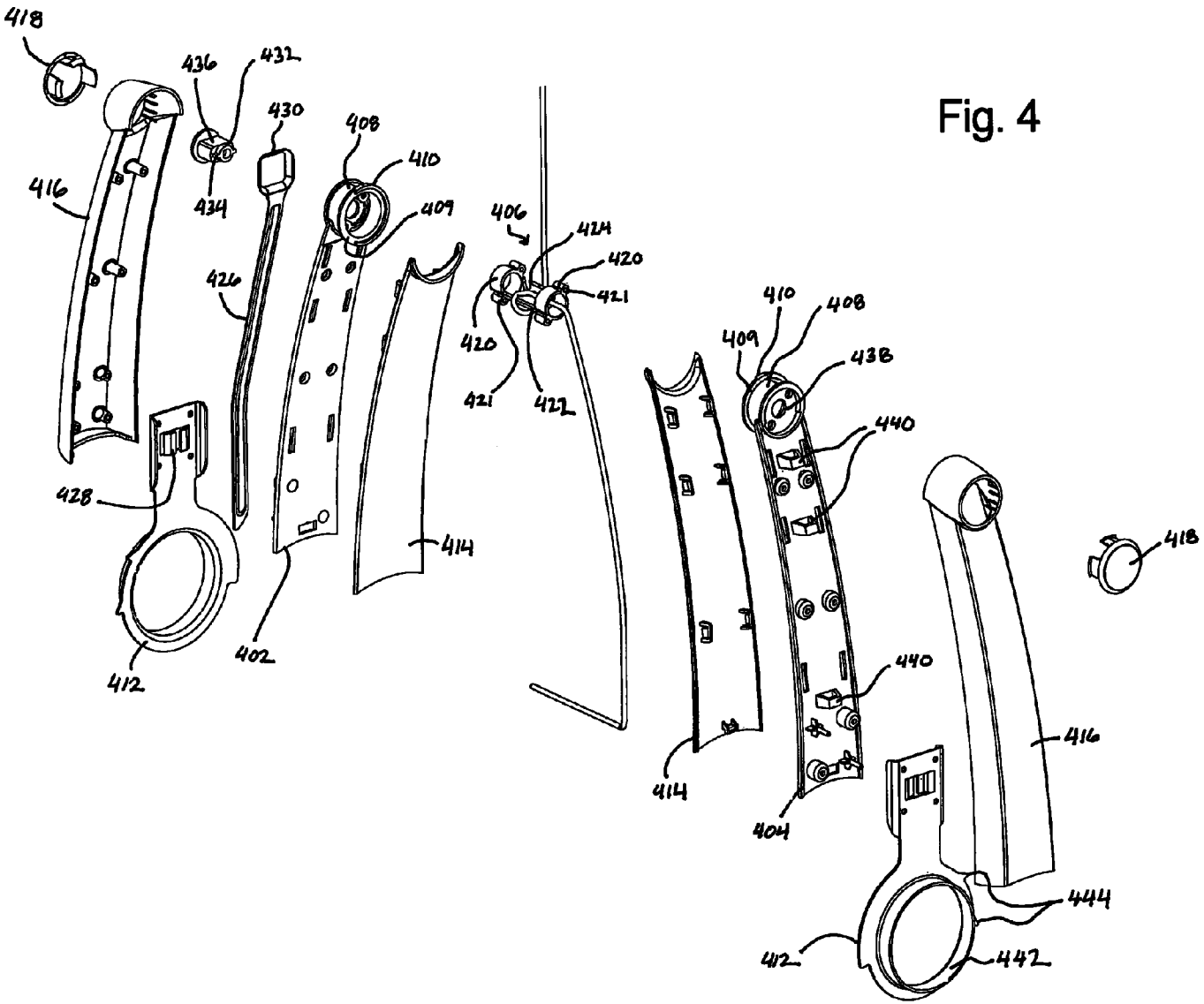
FIG. 4 is an exploded perspective drawing of the lower handle assembly of the embodiment of FIG. 1A.
Figure 5:
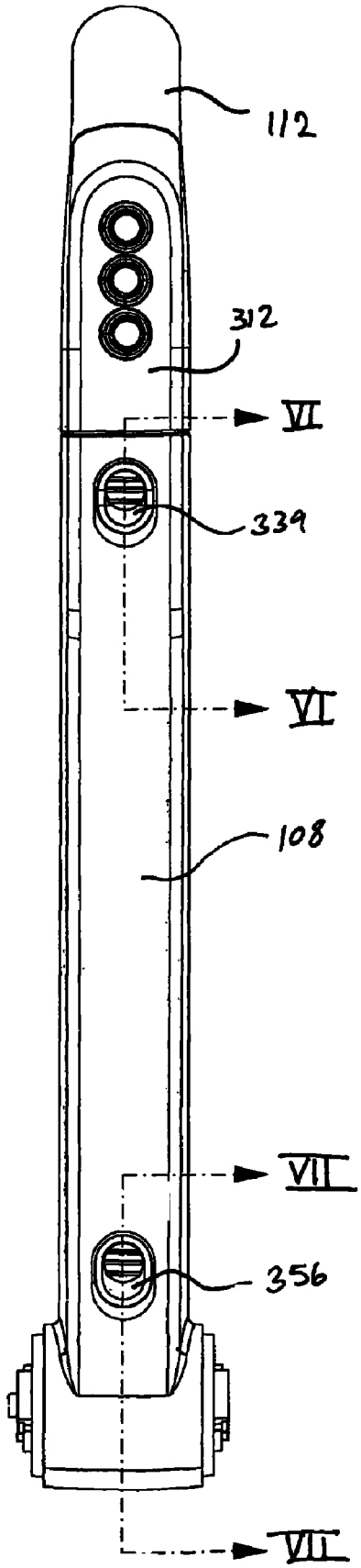
FIG. 5 is a front view of the upper handle assembly of the embodiment of FIG. 1A.

Referring now to FIG. 4, a preferred lower handle 106 is illustrated and discussed. The lower handle 106 comprises a first upright member 402 and a second upright member 404 that are joined to one another at their uppermost ends by a lower handle axle 406. The lower handle axle 406 comprises a pair of end rings 420, each of which has a pair of screw bosses 421 for receiving screws 902 (FIG. 9) that hold the upright members 402, 404 in place. The end rings 420 have a partially-open cylindrical center portion 422 extending between them. While screws 902 are preferred to join the upright members 402, 404 to the lower handle axle 406, other attachment mechanisms may be used.

A lower pivot ring 412 is attached to the bottom end of each upright member 402, 404 by screws or other mechanisms. Each pivot ring has a cylindrical flange 442, and one or both pivot rings 412 may include one or more radially-extending catches 444. The purpose and details of the pivot rings 412 are described subsequently herein.

The upright members 402, 404 may be encased between respective inner housing shells 414 and outer housing shells 416. These may be added to provide an improved cosmetic appearance, to add structural strength, to cover internal parts, and so on. In the shown embodiment, the outer housing shells 416 are attached to the upright members 402, 404 by screws, and the inner housing shells 414 are attached by snap fitment. Of course, other attachment mechanisms may be used instead. Caps 418 are provided for each outer housing shell 416 to cover the ends of the lower handle axle 406.

The upright members 402, 404 each include a cylindrical pivot surface 408. The pivot surfaces 408 extend with their cylindrical axes oriented horizontally and colinearly. As shown in FIGS. 8 and 9, the cylindrical pivot surfaces 408 are shaped and sized such that the front and rear pivot surfaces 328, 330 of the upper handle 108 fit around them to form a pivoting joint. As such, the pivot surfaces 328, 330, 408 preferably comprise a relatively low-friction material to allow free rotation between them, and may have an additional bushing or bearing placed between them. A radial wall 409 is positioned at the inner end (that is, the end towards the longitudinal centerline of the device) of each pivot surface 408, and extends radially therefrom. The radial walls 409 abut corresponding radial walls 802 (FIGS. 8 and 9) formed on the upper handle 108 inward of each pivot surface 328, 330. Abutment between the radial walls 409, 802 prevents lateral movement between the lower handle 106 and upper handle 108. The cylindrical pivot surfaces 408 are also shaped and sized to surround the end rings 420 of the lower handle axle 406 to provide a compact assembly, as shown in FIG. 9.

As shown in FIGS. 4, 8 and 9, the first and second upright members 402, 404 each also include an axially-extending annular wall 410 that extends inwardly from the pivot surface 408. The annular walls 410 are conveniently located at the outermost radial extent of the radial walls 409, but other locations are possible. The annular walls 410 extend around a portion of the circumference of each pivot surface 408, but each includes a gap into which a respective tooth 364 of the mid-handle joint lock 352 can fit, as best shown in FIG. 8. In this position, the teeth 364 engage the annular walls 410, and thereby prevent the upper handle 108 from pivoting rearward with respect to the lower handle 106. When it is desired to unlock the upper handle 108, the operator actuates the mid-handle joint lock 352 by pressing down on the operating button 356, which moves the teeth 364 downwards and out of engagement with the annular walls 410. Once the teeth 364 are out of engagement, the upper handle 108 may be pivoted backwards to the folded position. While only a single gap in the annular walls 410 is shown, additional gaps may be provided to engage with the teeth 364 at multiple different angular positions.

As shown in FIG. 8, the upper handle axle 334 fits concentrically within the lower handle axle 406. When the upper handle 108 is in the unfolded position, the rearwardly-extending mounting bosses 332 (upon which the upper handle axle 334 is mounted, as previously described herein) abut the lower handle axle 406 along the front edge 708 of its center portion 422. This abutting relationship prevents the upper handle 108 from pivoting any further forward with respect to the lower handle 106. Similarly, when the upper handle 108 is rotated backwards, abutment between the mounting bosses 332 and the rear edge 710 of the lower handle axle 406 may be used as a convenient rotation stop. If necessary, a pair of cutouts 422 may be provided on the rear edge 710 of the lower handle axle 406 to allow the mounting bosses 332 to clear the lower handle axle 406 and provide the desired rearward pivoting range of motion. These cutouts 422 also facilitate installing the screws 702 that hold the upper handle axle 334 onto the mounting bosses 332.

Figure 10:
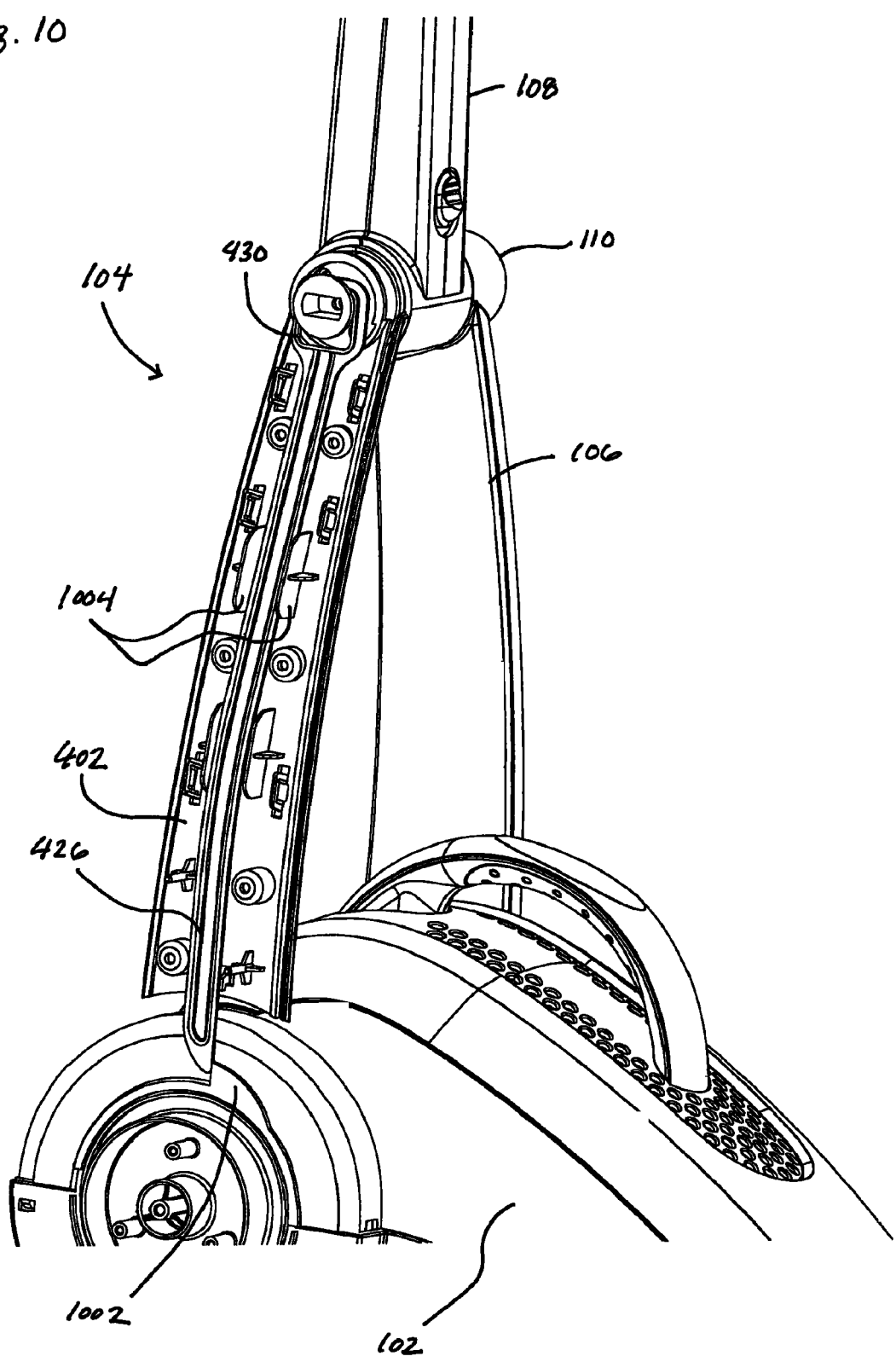
FIG. 10 is a fragmented perspective view of the lower handle of the embodiment of FIG. 1A, shown with various parts removed for clarity.

Referring now to FIGS. 4, 9 and 10, the handle 104 may also include a mechanism that prevents it from rotating on the base 102 from the upright resting position until the user desires to fold the handle 104 forward for storage. Preferably, this mechanism can be operated automatically in conjunction with the mid-handle joint lock 352 to minimize the effort required to fold the handle 104. To this end, the first upright member 402 of the lower handle 106 includes a locking bar 426, which engages a corresponding catch 1002 on the side of the base 102 and prevents the lower handle 106 from pivoting forward relative to the base 102. If desired, the second upright member 404 may also include its own locking bar 804, as shown in FIG. 8, but a single locking bar is believed to be sufficient for the illustrated embodiment.

As shown in FIGS. 4 and 10, the locking bar 426 comprises a thin elongated member that extends from the mid-handle joint 110 to the bottom of the lower handle 106. The locking bar 426 is located between the first upright member 402 and its associated outer housing shell 416 (removed in FIG. 10), and slides along the side of the upright member 402 between several locating walls 1004. The locking bar 426 also slides within a locating channel 428 in the lower pivot ring 412, which provides rigidity at a location proximal to the catch 1002 to help prevent inadvertent release. When the locking bar 426 is in the position shown in FIG. 10, it engages the catch 1002, and prevents the handle 104 from rotating forward.

The locking bar 426 is released from the catch 1002 by sliding it upwards along the side of the first upright member 402. This can be accomplished in a number of ways, but in a preferred embodiment, it is performed by lifting the locking bar 426 by a loop 430 located adjacent the mid-handle joint 110. As shown in FIG. 4, the loop 430 comprises a generally square opening through the locking bar 426. A lifting cam 432 passes through the loop 430 and is attached to the upper handle axle 334 by a screw 904, as shown in FIG. 9. The lifting cam 432 and upper handle axle 334 may also include a mechanical engagement mechanism to prevent relative rotation between the two if the screw loosens. For example, the cam 432 may have a tab 434 (FIG. 4) that fits into a corresponding slot 366 (FIG. 3) in the end of the upper handle axle 334.

The lifting cam 432 has lobed profile with one or more areas having a relatively large radius, and one or more flats 436 or other areas having a relatively small radius. When the upper handle 108 is in the unfolded position, the cam 432 is oriented such that the flat 436 abuts the upper end of the loop 430 and allows the locking bar 426 to drop to a relatively low position and engage with the catch 1002. A spring (not shown) may be provided to force the locking bar 426 downwards. When the upper handle 106 is rotated relative to the lower handle 106, the upper handle axle 334 rotates and turns the cam 432 such that the a portion of cam 432 having a larger radius abuts the loop 430, and thereby lifts it upwards along the first upright member 402. The change in radius of the cam 432 is sufficient to lift the locking bar 426 completely out of engagement with the catch 1002, thus allowing the lower handle 106 to rotate forward into the folded position.

While the foregoing cam and follower arrangement is preferred, other mechanisms may be used, such as a mechanical linkage, cables, and so on. Such alternatives will be readily apparent to those of ordinary skill in the art in view of the present disclosure.

The upper and lower handles 108, 106 and their respective parts may be assembled in any useful manner and made from any suitable materials. Generally plastic materials are suitable, but some parts may benefit from the increased strength of metal. Such parts include the telescoping tube 314, rollers 340, handle axles 334, 406, upright members 402, 404, pivot rings 412, and locking bar 426.

A number of variations on the illustrated handle locking mechanism may be provided with the present invention, and the invention is not limited to the shown types of locks or manner of operating them. For example, the telescoping lock 337 and mid-handle joint lock 352 may be mechanically joined and operated by a single pushbutton. As another example, the mid-handle joint lock 352 may be operated by a pushbutton located at the bottom of the internal sleeve 326 on the upper handle 108, and actuated by pressing the telescoping tube 314 against it. Such an internal operating mechanism may take the place of the existing operating button 356, or be provided as an alternate unlocking mechanism. As still another variation, the device may include a mechanism for operating the lower pivot locking bar 426 separately from the mid-handle pivot lock 352. For example one of the lower handle caps 418 may be replaced by a rotatable dial that allows the operator to manually lift the locking bar 426. In another variation, the locking bar 426 may instead be used to activate a lever or other mechanism on the base 102 to release the handle 104 to allow forward rotation. For example, the pivot ring 412 may be modified to include an additional catch 444 that contacts the lower pivot lock 1374 (FIG. 13) to prevent the handle 102 from rotating forward, and the locking bar 426 may press down on the lower pivot lock 1374 (FIG. 13) to release the locking pin 1376 (FIG. 13) from this additional catch 444 to allow forward rotation. In this latter embodiment, forward rotation may also be obtained by depressing the lower pivot lock 1374. Other variations will be apparent to those of ordinary skill in the art with consideration of the present disclosure and routine experimentation with embodiments of the invention.

The present invention also provides a novel electrical routing system for a folding handle. While this electrical routing system is shown in use with a vacuum cleaner, it is expected to be useful in other devices in which it is desired to include an electrical control at the end of a folding handle. As previously noted, a control plate 312 is provided on vacuum cleaner grip 112, and a control wire bundle 320 is attached to the control plate 312. The wire bundle 320 extends through the telescoping tube 314, with enough slack to allow the upper handle 108 to be fully extended without unduly stretching or breaking the wire bundle 320. In a preferred embodiment, this slack is provided by forming a coil 321 in the wire bundle 320, which, by nature of its naturally coiled relaxed shape, retracts to some degree when the upper handle 108 is compressed to help prevent it from being pinched between the telescoping tube 314 and sleeve 326.

As shown in FIGS. 4 and 7, the wire bundle 320 exits the telescoping tube 314, then passes behind and wraps around the bottom of the lower handle axle 406. This causes the wire bundle 320 to slacken somewhat when the upper handle 108 is pivoted backwards on the lower handle 106. Some or all of this slack may be taken up by compression of the coiled portion 321 of the wire bundle 320. The wire bundle 320 passes between the spring perch 704 and the front edge 708 of the lower handle axle 406, and into a hole 368 through the front of the upper handle axle 334. As shown in FIG. 9, the wire bundle 320 then passes axially through the hollow upper handle axle 334 and exits a second hole 370 through the end of the upper handle axle 334.

Figure 11:
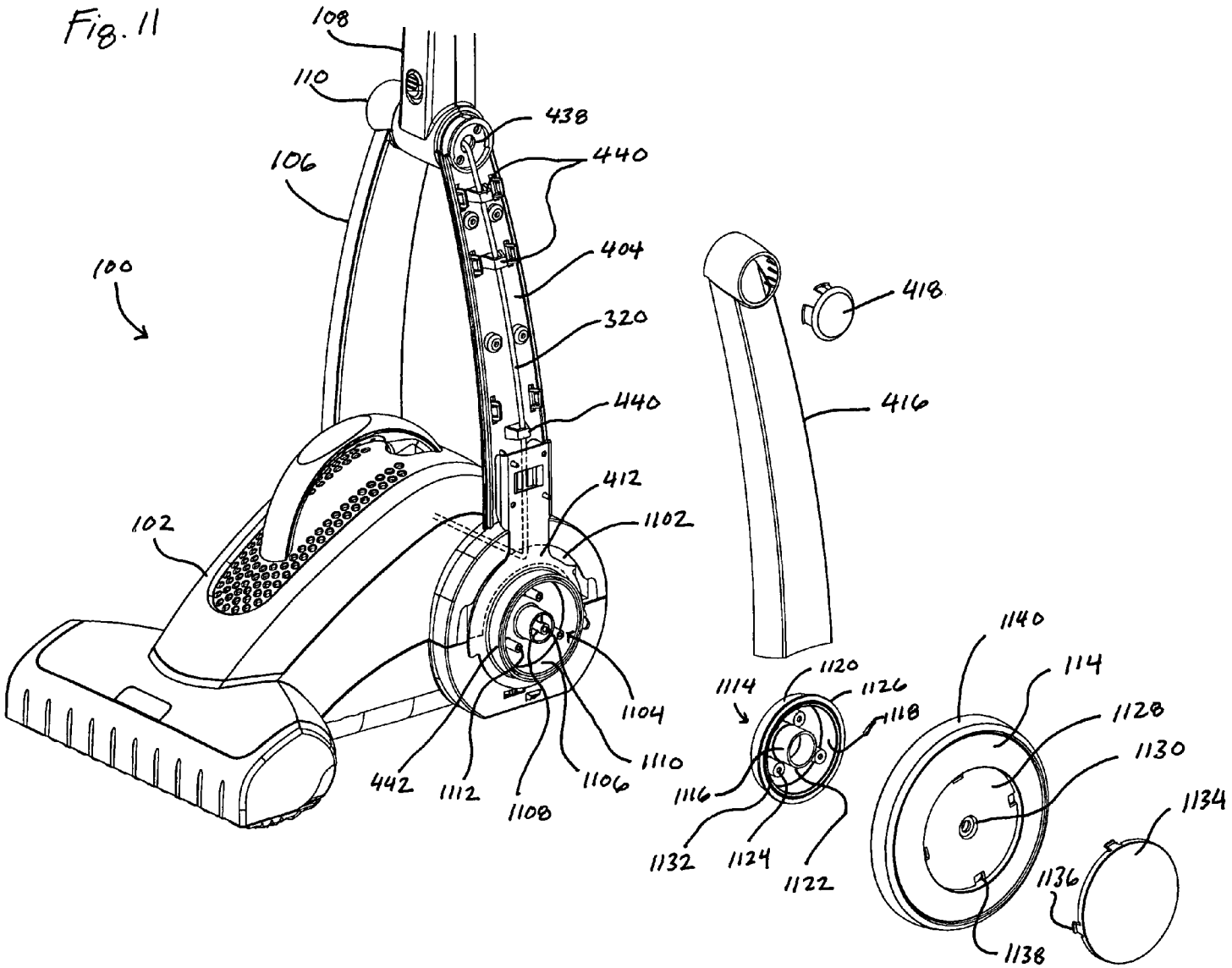
FIG. 11 is a fragmented and partially exploded perspective view of the lower handle of the embodiment of FIG. 1A.
Figure 12:
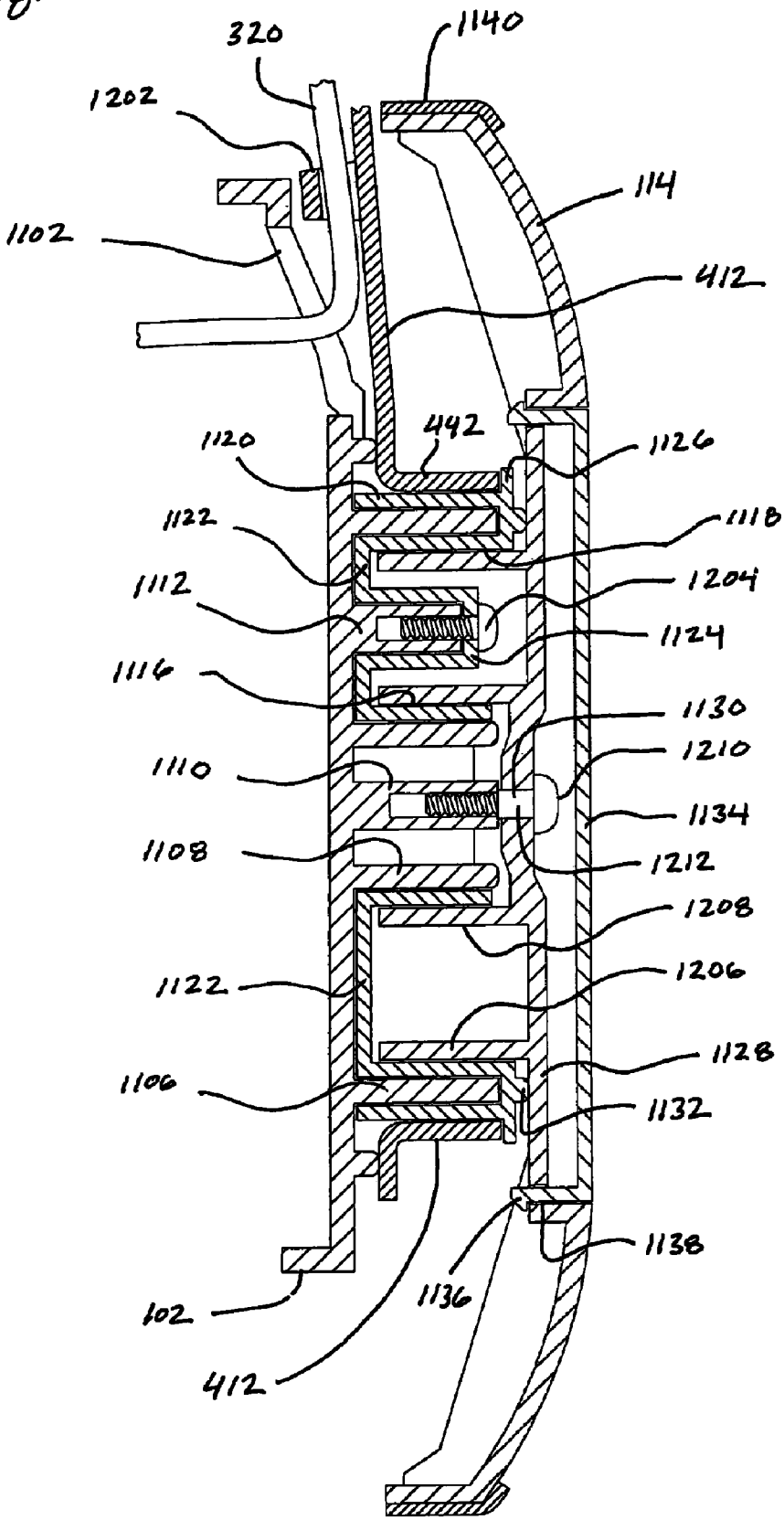
FIG. 12 is a section view of a handle and wheel mounting assembly of the embodiment of FIG. 1A.

Referring now to FIG. 11, the hole 370 through the end of the upper handle axle 344 communicates with a corresponding hole 438 through the second upright member 404 of the lower handle 106. The wire bundle 320 passes through this hole 438 and extends down the second upright member 404. One or more wire loops 440 or clips may be provided to contain the wire bundle 430, and prevent it from sliding and abrading as the handle 104 is pivoted. Referring also to FIG. 12, the base 102 includes a generally semi-circular slot 1102 located around the upper half of one wheel mounting region. The wire bundle 320 passes into this slot 1102, and thence into the vacuum cleaner 100 interior where it is attached to the electrical circuit in a conventional manner. The slot 1102 allows the handle 102 to be pivoted through a large arc without pulling or binding the wire bundle 320.

It will be appreciated that various clips, springs, tensioners or other retainers or devices may be provide at any suitable location along the wire bundle 320 to hold it in place, take up slack, and prevent chafing, rubbing, pinching, and/or the risk of being damaged by undue stretching. For example, a retaining loop 1202 (FIG. 12) may be provided near the inner surface of the pivot ring 412 to hold the wire bundle 320 and prevent it from chafing against the base 102. This retaining loop 1202 may be formed by a stamped or molded extension of the pivot ring 412, by the inner housing shell 414 (FIG. 4), or by other suitable means.

A preferred attachment between the lower handle 106 and the base 102 is illustrated in FIGS. 11 and 12. In this embodiment, the base 102 includes a pair of mounting members 1104 (only one of which is visible) that extend laterally from opposite sides of the rear portion of the base 102. Each mounting member 1104 includes an outer flange 1106, an inner flange 1108 located concentrically within the outer flange 1106, a central wheel screw boss 1110 located concentrically within the inner flange 1108, and three retainer screw bosses 1112 located between the outer and inner flanges 1106, 1108. The outer and inner flanges 1106, 1108 comprise generally cylindrical axially-extending walls, and may be slightly tapered as they extend away from the base 102.

A retainer ring 1114 attaches to each mounting member 1104. Each retainer ring 1114 includes three generally cylindrical bushing surfaces: an inner bushing 1116, a medial bushing 1118, and an outer bushing 1120. The inner and medial bushings 1116, 1118 are joined by a radial wall 1122, from which three mounting posts 1124 protrude. The mounting posts 1124 are shaped to fit over the retainer screw bosses 1112 and screws 1204 pass through these parts to hold the retainer ring 1114 in place, as shown in FIG. 12. When attached in this manner, the retainer ring inner bushing 1116 surrounds the inner flange 1106, and the medial bushing 1118 and outer bushing 1120 are located just inside and outside the outer flange 1108, respectively.

As best shown in FIG. 12, the pivot ring 412 includes an outwardly-turned cylindrical flange 442 that fits over the outer bushing 1120. The pivot ring 412 is installed concentrically around the mounting member 1104, with the outer bushing 1120 of the retainer ring 1114 located between the pivot ring's cylindrical flange 442 and the outer flange 1108. The retainer ring 1114 includes an outer radial lip 1126, located at the outer end of the outer bushing 1120, that captures the cylindrical flange 442, and thus the lower handle 106, in place. The retainer ring thus simultaneously affixes the lower handle 106 to the base 102 and provides a bearing surface upon which it can rotate. To this end, the outer bushing 1120 preferably is made of a relatively low-friction and/or self-lubricating material, as are known in the art. The outer bushing 1120 also may include one or more slots or holes to help evacuate dust or debris that might be captured between the outer bushing 1120 and the pivot ring flange 442. A grease fitting (not shown) or oiling hole may be provided if a lubricated joint is used. Furthermore, while it is preferred to form the outer bushing 1120 and retainer ring 1114 as a single part, they may instead be separate parts.

The retainer rings 1114 also provide bearing surfaces for the rear wheels 114. As best shown in FIG. 12, each rear wheel 114 includes an outer wheel flange 1206 and an inner wheel flange 1208. The wheel flanges 1206, 1208 are formed as generally cylindrical extensions of the material that forms the main body of the wheel 114, preferably a rigid plastic, or otherwise attached to the wheels 114. Each wheel 114 also includes a recessed center portion 1128 and a central hole 1130 at the circular center of the wheel 114. As shown in FIG. 12, the wheel 114 is attached to the mounting member 1104 by a screw 1210 that passes through the central hole 1130 and into the wheel screw boss 1110. The screw 1210 may include an unthreaded shank 1212 that is somewhat longer than the thickness of the wheel 114 to prevent it from clamping the wheel 114 too tightly against the wheel screw boss 1110.

When the wheel 114 is installed over the retainer ring 1114, the outer wheel flange 1206 is adjacent the medial bushing 1118, and the inner wheel flange 1208 is adjacent the inner bushing 1116. In use, the wheels 114 support the vacuum cleaner 100 by a sliding contact relationship between the medial and inner bushings 1118, 1116 and the outer and inner wheel flanges 1206, 1208. As such, like the outer bushing, 1120, the medial and inner bushings 1118, 1116 are preferably made of a low friction or self-lubricating material. In addition, the retainer ring 1114 preferably also includes an axially-extending annular protrusion 1132 against which the inner surface of the wheel 114 can slide when it is fully installed. This protrusion 1132 is expected to allow the wheel 114 to be installed with a relatively small gap (or no gap) between the wheel 114 and the non-rotating parts, to thereby improve product fit and finish and reduce wheel vibration and other undesirable conditions associated with loose wheels.

As with the outer bushing 1120, the inner and medial bushings 1116, 1118 may alternatively be separate pieces, and may includes lubrication holes or fittings, dirt removing slots, bearings or other useful features to provide a rotating joint. Still other variations of the foregoing wheel and handle attachments will be apparent to those of ordinary skill in the art in view of the present disclosure.

The wheels 114 may include various additional features to improve their performance or aesthetic appearance. For example, each rear wheel 114 includes a hubcap 1134 to cover the recessed center portion 1128 and mounting screw 1210. In a preferred embodiment, each hubcap 1134 comprises a generally flat circular part having a number of axially extending snap tabs 1136 that fit into corresponding openings 1138 in the wheel 114. When attached, the hubcaps 1134 provide a smooth outer appearance, and protect the wheel attachment from dirt, hair, and other debris. The wheels 114 also may include an overmolded or otherwise attached tread surface 1140. Other features will be apparent to those of ordinary skill in the art in view of the present disclosure.

Figure 13:
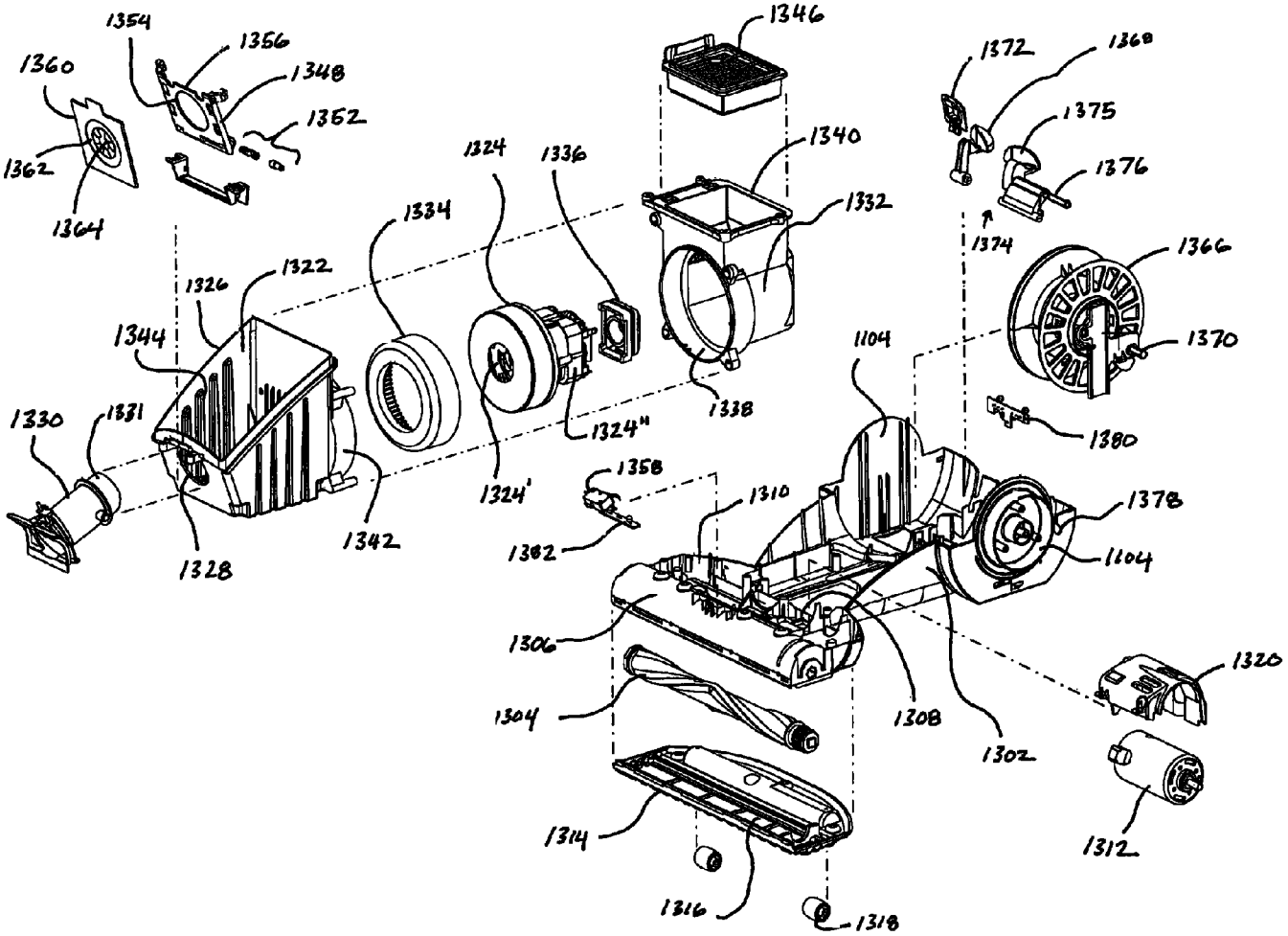
FIG. 13 is an exploded perspective view of parts of the base portion of the embodiment of FIG. 1A.
Figure 14:
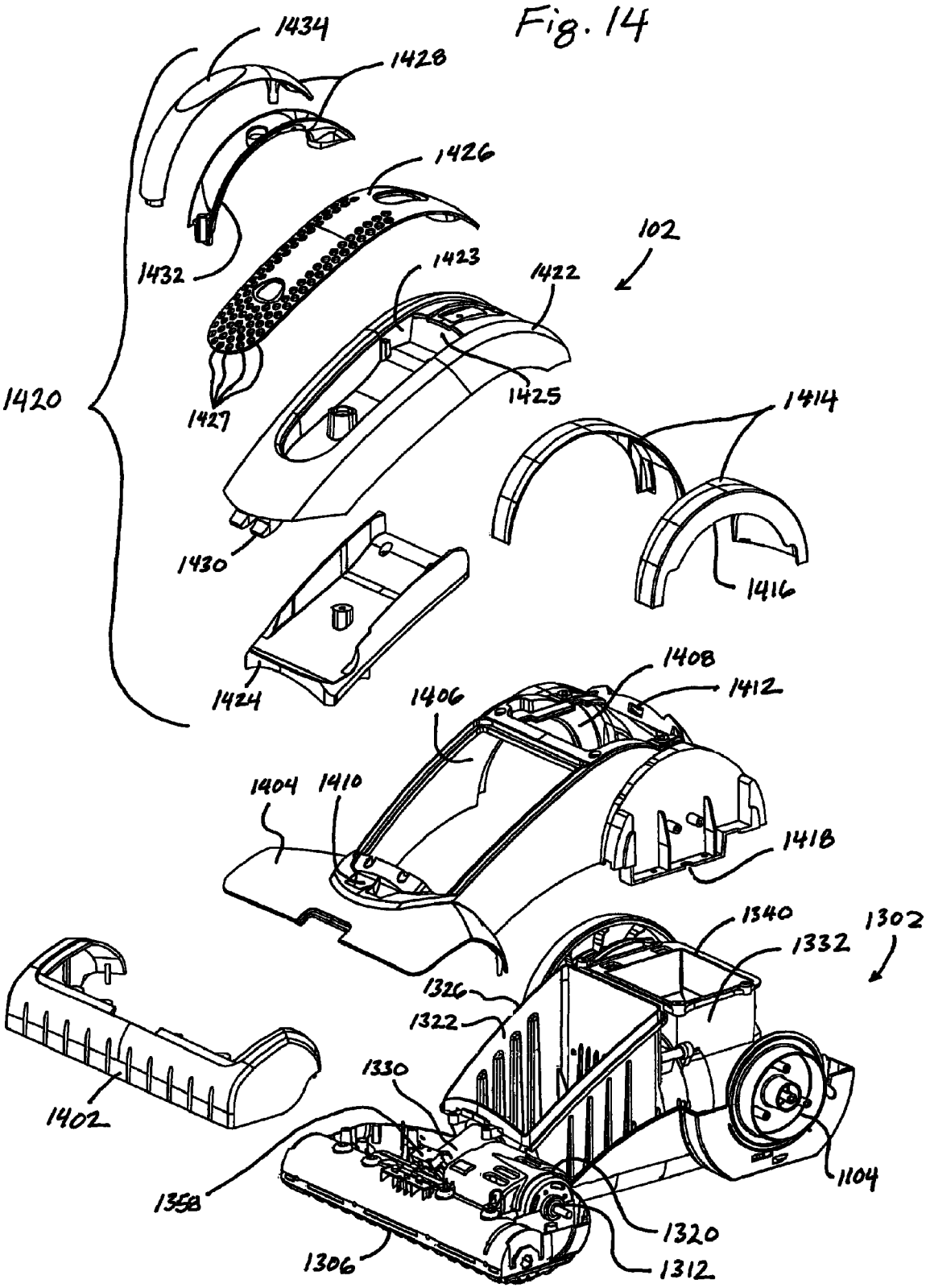
FIG. 14 is a partially exploded perspective view of parts of the base portion of the embodiment of FIG. 1A.
Figure 15:
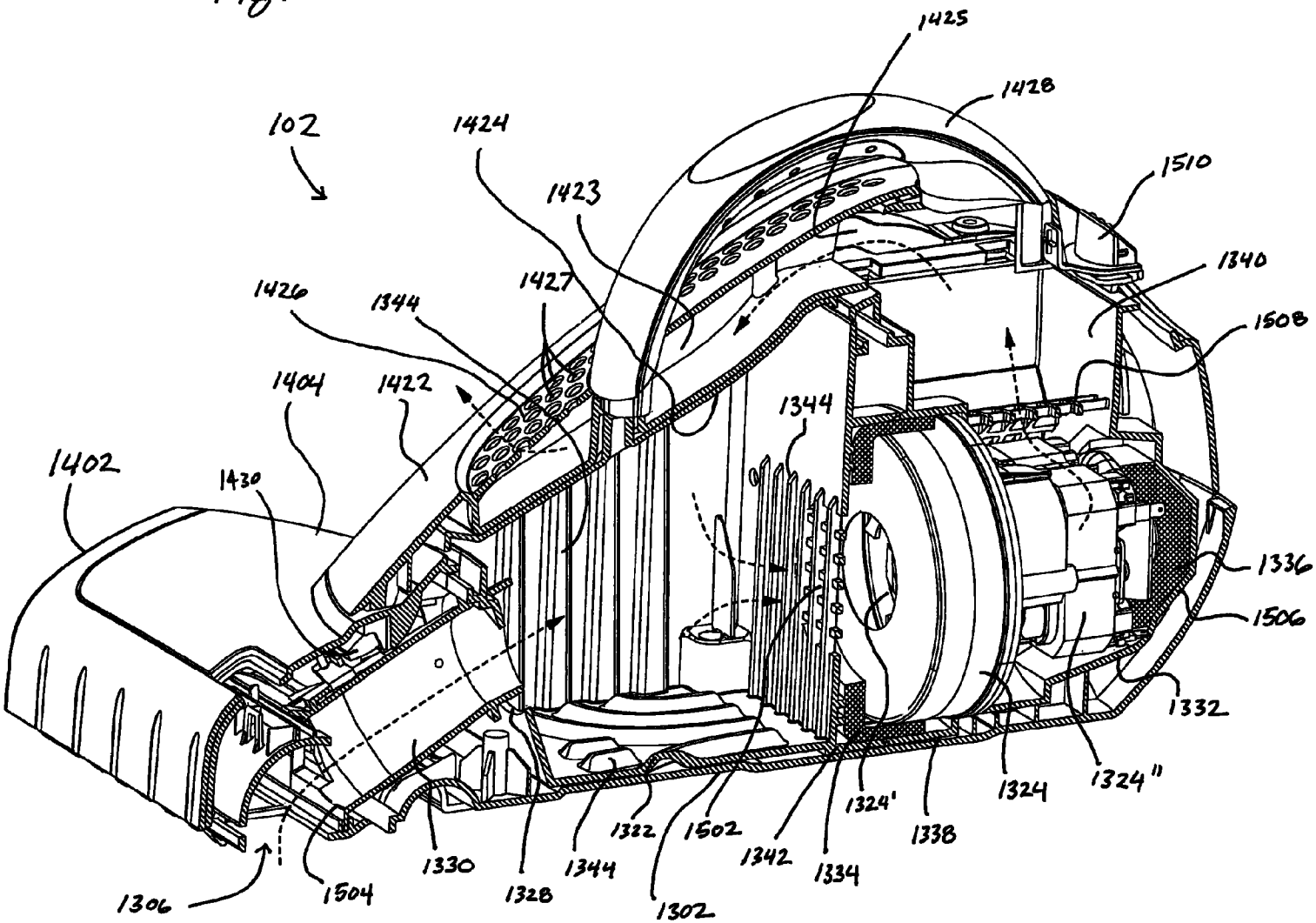
FIG. 15 is a cutaway perspective view of the base portion of the embodiment of FIG. 1A.

Referring now to FIGS. 13 to 15, the construction of the base 102 is described in more detail.

The base 102 comprises a lower base housing 1302 that serves as the structural platform upon which the vacuum cleaner base 102 is constructed. The lower base housing 1302 includes, at its forward end, a downwardly-facing and laterally-elongated air inlet nozzle 1306 that is adapted to face and apply suction to or near a surface that is desired to be cleaned. While it is not required, it is preferred to provide a brushroll 1304 in the inlet nozzle 1306 to agitate the surface. The brushroll 1304 is rotatably disposed within the inlet nozzle 1306, and covered by a soleplate 1314 having a number of apertures 1316 through which the brushroll's agitating members (bumps, flaps, bristles, or the like) extend to contact the surface being cleaned. The soleplate 1314 (or the bottom of the housing 1302) may also include support wheels 1318 or skids (not shown) to regulate the height of the inlet nozzle 1306 relative to the surface. The wheels 1318 or other support mechanisms may be adjustable so that the user can control the inlet nozzle 1306 height.

In the embodiment of FIG. 13, the brushroll 1304 is driven by an electric brushroll motor 1312, which fits into a brushroll chamber 1308 located behind and to one side of the inlet nozzle 1306. The brushroll motor 1312 may include a mechanical clutch and/or an electrical heat or overcurrent protection device to disable the brushroll motor 1312 and/or brushroll 1304 when a jam, clog or other fault condition is detected. The brushroll 1304 may alternatively be driven by the fan/motor 1324 by any suitable drive mechanisms, such as belts, pulleys, cables, and the like.

A brushroll motor cover 1320 may be provided to capture the brushroll motor 1312 in place in the lower base housing 1302. The brushroll motor cover 1320 may also seal around the brushroll motor 1312 and have an air outlet connected to the vacuum cleaner's dirt filtration system to filter out any carbon dust or other debris generated by the brushroll motor 1312 itself. While the brushroll motor cover 1312 is shown as a separate housing part, it may instead simply comprise tie-down straps, or be formed as part of the underside of the upper base housing 1404 (FIG. 14), which covers and encloses the lower base housing 1302.

Such brushrolls 1304, support wheels 1318, soleplates 1316, motors 1312, and variations thereof, are known in the art. Any useful combination of these and other features may be used with the present invention. Other features commonly used with vacuum cleaner inlets and brushrolls, such as downwardly-extending skirts or bristles, edge cleaning brushes, viewing windows, and the like, may also be used with the present invention.

A main circuit board chamber 1310 is located in the front portion of the lower base housing 1302, preferably behind the inlet nozzle 1306 on the opposite lateral side of the housing 1302 as the brushroll motor chamber 1308. A main circuit board (not shown) is positioned within this chamber 1310, and provides various electrical control functions for the device. For example, the main circuit board may include pressure differential sensors to determine when filters are preventing adequate airflow through the device. The main circuit board also may control electronics to operate the motor(s), shut off the device in the event of fault or safety conditions, regulate battery charging, and so on. These and other functions are known in the art, and any variations thereof may be used with the present invention.

Referring now to FIGS. 13 and 15, the lower base housing 1302 also holds the vacuum cleaner's dirt separation system, which generally comprises a bag chamber 1322 and a vacuum fan and motor assembly or "fan/motor" 1324. While the shown embodiment is described having a filter bag as the primary dirt separation feature, the present invention could alternatively use a cyclone separator or a dust collection box, as are well-known in the art. For example, if it is desired to use a dust collection box, the bag chamber 1322 may be replaced by a chamber having a spring-loaded entry door (to prevent the reverse flow of dirt out of the chamber) and one or more filters (such as coarse and fine filters that empty into the same or separate chambers) to remove particles before the working air flow enters the fan/motor 1324. A cyclone separator, such as the one shown in U.S. Pat. No. 6,406,505, for example, could also be provided. The foregoing patent is incorporated herein by reference. The substitution of such separation devices for the shown bag chamber 1322 will be apparent to those of ordinary skill in the art in view of the present disclosure, and without undue experimentation, and such substitutions are within the scope of the present invention.

The bag chamber 1322 comprises a box-like structure having an open top 1326, an air inlet 1328, and an air outlet 1502 (FIG. 15). A pre-motor filter (not shown) of any suitable construction may optionally be provided to cover or lie beneath the air outlet 1502. Such pre-motor filters are well-known in the art. As best shown in FIG. 15, a nozzle adapter 1330 fluidly connects the inlet 1328 to an opening 1504 in the back of the inlet nozzle 1306. The air outlet 1502 comprises a grated opening that exits the bag chamber 1322 adjacent the inlet to an impeller 1324' portion of the fan/motor 1324.

The bottom and side walls of the bag chamber 1322 preferably include a number of ribs 1344. When a filter bag (not shown) is positioned within the bag chamber 1322, the ribs 1344 hold the bag away from the walls and thereby allow the working air flow to pass through a greater portion of the bag's surface area, as known in the art. The ribs 1344 may have any useful shape that promotes increased airflow to the bag chamber outlet 1502.

In the shown embodiment, the fan/motor 1324 comprises a single unified part that combines an air impeller 1324' and an electric motor 1324" in a compact package. Such combined units are well-known in the art. Of course, the impeller 1324' and motor 1324" may optionally be provided separately, if desired. The fan/motor 1324 preferably is mounted within a motor shroud 1332 that is attached to the back of the bag chamber 1322 to ensure proper alignment between them. The motor shroud 1332 has a motor shroud inlet 1338 located adjacent the bag chamber outlet 1502, and a motor shroud outlet 1340 located vertically above the fan/motor 1324. The motor shroud inlet 1338 abuts a correspondingly-shaped outlet flange 1342 on the bag chamber 1322 to provide an airtight passage from the bag chamber outlet 1502 to the impeller 1324'. A motor outlet grill 1508 (FIG. 15) may be provided within the motor shroud 1332 downstream of the fan/motor 1324 to prevent objects from falling into the fan/motor 1324 and prevent the escape of any large objects that might be ejected by the fan/motor 1324. The motor shroud 1332 may also include foam lining or other features to reduce operating noise.

The motor is suspended within the shroud 1332 by a front motor gasket 1334 and a rear motor mount 1336. As shown in FIG. 15, the gasket 1334 fits between the outer periphery of the impeller 1324' and the motor shroud inlet 1338. A portion of the gasket 1334 also fits within and seals against the bag chamber's outlet flange 1342. The rear motor mount 1336 fits around the back of the motor 1324" and within a pocket 1506 in the motor shroud 1332. The gasket 1334 and mount 1336 preferably comprise elastic materials that firmly support the fan/motor 1324, but still provide some vibration damping, and, in the case of the gasket 1334, an airtight seal around the impeller 1324'. Natural rubber or other known materials may be used.

The vacuum cleaner's dirt separation system may also includes a post-motor filter 1346 (not shown in FIG. 15) located downstream of the fan/motor 1324 to clean the working air before it exits the vacuum cleaner. In a preferred embodiment, the post-motor filter 1346 is shaped to fit within the motor shroud outlet 1340. Various tabs or latches may be provided to hold it in place during operation, or it may simply be captured in place. The post-motor filter 1346 may comprise any filtration medium having any shape or form, such as a foam sheet or block, a pleated sheet rigidly held in a frame, a rigid panel, a flexible sheet, and so on. A preferred post-motor filter 1346 comprises a pleated filter that is potted into a somewhat flexible rectilinear frame, as shown in FIG. 13. The post-motor filter 1346 may also have any filtration performance grade, such as HEPA grade (an acronym for "High Efficiency Particle Air," which is standardized as being capable of removing 99.97% of particles 0.3 microns in size or larger), or ULPA grade (an acronym for "Ultra Low Penetration Air," which is standardized as being capable of removing 99.999% of particles 0.12 microns in size or larger). Of course, lesser or greater grades of filtration media may also be used. The post-motor filter 1346 may also include a layered set of filters having odor- or chemical-reducing features, electrostatic properties, or other features, as will be appreciated by those of ordinary skill in the art.

Figure 16A:
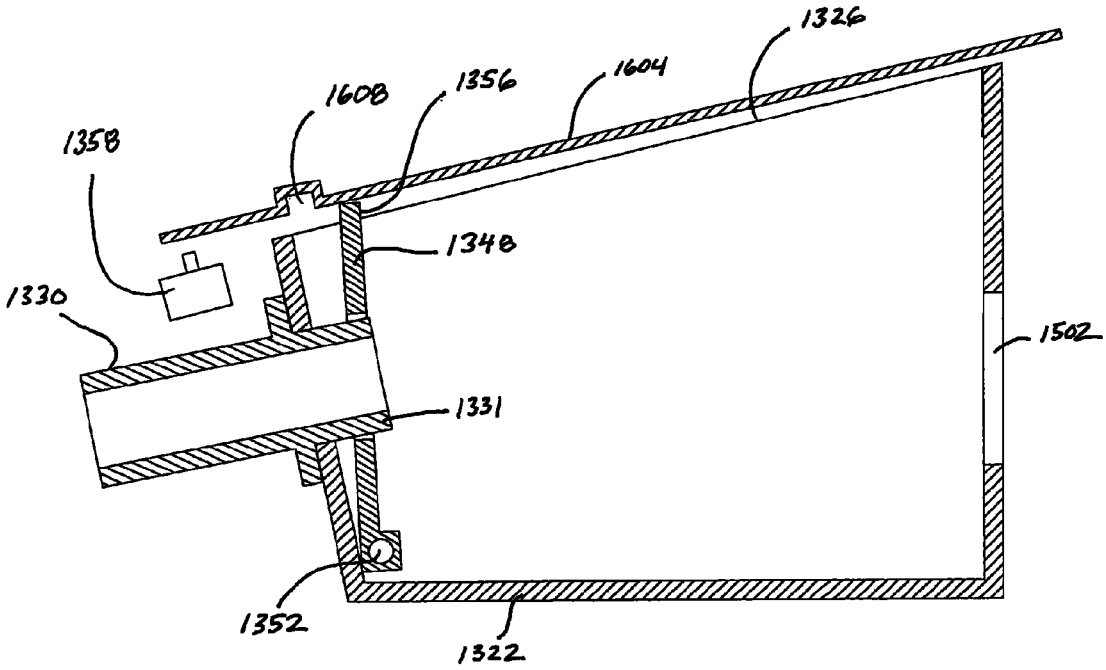
FIG. 16A is a cutaway side view of an embodiment of a bag-in-place feature of the present invention, shown without a bag in the bag chamber.
Figure 16B:
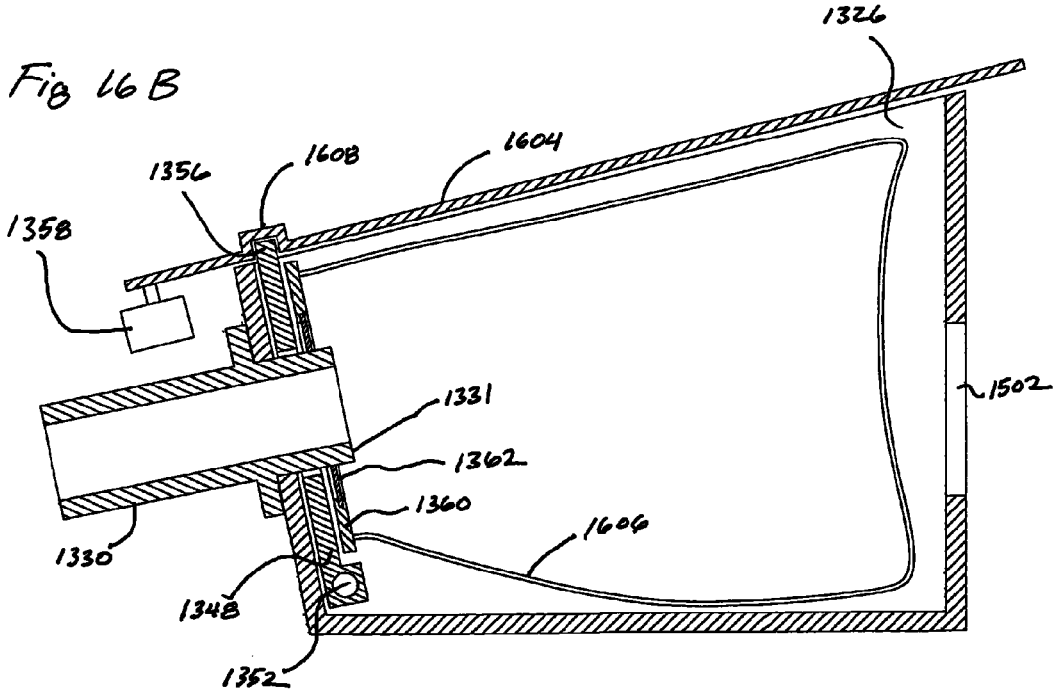
FIG. 16B is a cutaway side view of the bag-in-place feature of FIG. 16A, shown with a bag in the bag chamber.

The dust separation system may also include a bag-in-place feature that prevents operation of the vacuum cleaner when no bag (or an improper bag) has been installed in the bag chamber 1322. As shown in FIGS. 13, 16A and 16B, an embodiment of a bag-in-place features comprises a pivoting panel 1348 that is attached inside the bag chamber 1322 adjacent the air inlet 1328 on a bracket 1350. As shown in FIG. 16, a tubular end 1331 of the nozzle adapter 1330 extends into the bag chamber 1322, and the pivoting panel 1348 includes a central hole 1354 that fits around this the end 1331 of the nozzle adapter 1330. A spring-loaded pivot assembly 1352 biases the pivoting panel 1348 away from the air inlet 1328 when no bag is installed in the bag chamber 1322. In this position, shown in FIG. 16A, the upper end 1356 of the pivoting panel 1348 interferes with the bag chamber lid 1604, and prevents its installation. This mechanical interference provides the user with an indication that no bag is present and that one must be inserted before continuing. The bag-in-place feature may also include an electrical cutoff switch 1358 (FIG. 13) that must be engaged before the electrical system will operate, and which can only be engaged when the bag chamber lid 1604 is properly installed. This cutoff switch 1358 provides a second feature to prevent operation without a bag.

The bag-in-place feature is overcome by installing the proper vacuum bag 1606 in the bag chamber 1322. The vacuum bag 1606 includes a mounting flange 1360 having an elastic seal 1362 surrounding its opening 1364. To install the bag 1606, the user presses the pivoting panel 1348 towards the bag chamber inlet 1328, and places the flange 1360 over the end 1331 of the nozzle adapter 1330. The opening 1364 through the elastic seal 1362 is smaller than the nozzle adapter 1330, and elastically grips against the nozzle adapter 1330. In doing so, the elastic seal 1362 holds the bag flange 1360 and pivoting panel 1348 in place against the spring-loaded pivot assembly 1352. In this position, the upper end 1356 of the pivoting panel 1348 fits within a slot 1608 in the bag chamber lid 1604, which allows the lid 1604 to be fully seated on the bag chamber 1322. Also in this position, the bag chamber lid 1604 engages the electrical cutoff switch 1358, and activates the vacuum cleaner's power circuit.

Various other features of dust separation systems may also be incorporated into embodiments of the present invention. Non-limiting examples of such well-known features include: pressure sensors to determine cleaning performance, air bleed ports, thermal cutoff devices, multistage separators, bag or cyclone filter cleaning features, and so on.

A vacuum cleaner of the present invention may be powered by batteries or a conventional power cord. When a power cord is used, it may be a conventional fixed external cord, or retractably mounted on a cordreel, as shown in FIG. 13. A preferred cordreel 1366 is mounted towards the rear of the housing 1302, and to one side of the fan/motor 1324. The cordreel 1366 is oriented horizontally and adjacent one of the wheel mounting members 1104, which protrude upwards from the lower base housing 1302. A cordreel release pedal 1368 is pivotally mounted in the lower base housing 1302 and adapted to actuate the cordreel brake 1370 to retract the cord. A spring (not shown) may be provided to bias the release pedal 1368 into the locked position. A cordreel guide 1372 may also be provided to provide an aesthetically-pleasing and low-friction passageway through the walls that form the base 102 and enclose the cordreel 1366. A separate cooling system, such as simple vents or a fan, may be provided for the cordreel 1366, or it may be cooled by the fan/motor 1324. In a preferred embodiment, the cordreel 1366 is cooled by a vacuum hose (not shown) that is extends between the cordreel 1366 and a location in the suction path, and thus uses the fan/motor 1324 to draw cooling air across or through the cordreel 1366.

This arrangement of the inlet nozzle 1306, bag chamber 1322, fan/motor 1324, and vertical cordreel 1366 has been found to provide a highly compact assembly, particularly when used in conjunction with a folding handle, as described previously herein. In addition, the position and shape of the inlet nozzle 1306, nozzle adapter 1330, bag chamber 1322 and fan/motor 1324 provides a relatively straight and short air flow path, which is expected to minimize suction loss between the fan/motor 1324 and the inlet nozzle 1306. While this arrangement is preferred, alternative arrangements are also expected to provide space savings and efficient operation. For example, the cordreel 1366 and/or the fan/motor 1324 may be partially or entirely contained within a large central hub of a rear wheels. In such an embodiment, it may be desirable to orient the fan/motor 1324 with its rotating axis parallel to and approximately concentric with the rear wheel rotation axis. In such an embodiment, the air may exit the vacuum cleaner through the wheel hub itself.

The lower base housing 1302 also includes a lower pivot lock 1374 that is adapted to engage one or both of the pivot rings 412 that mount the lower handle 106 to the base 102. As shown in FIG. 13, a preferred lower pivot lock includes a foot-operable pedal 1375 that is pivotally mounted in the lower base housing 1302 in any functional manner. A spring (not shown) biases the pedal 1375 into the locked position. A locking pin 1376 extends laterally from the pedal 1375, and through a slot 1378 located adjacent the wheel mounting member 1104. The locking pin 1376 is thus positioned to engage the catches 444 that protrude from the pivot ring 412, and hold the lower handle in various angular positions. In a preferred embodiment, there are two pivot ring catches 444: one to hold the lower handle 106 upright relative to the base 102, and another to hold the lower handle 106 at a backwards angle of about 30 to 60 degrees relative to the base 102. When the pedal 1375 is depressed, the locking pin 1376 moves along the slot 1378 and out of engagement with the catches 444, thus releasing the handle 102 to pivot freely. Each catch 444 may include one ramped side that automatically pushes the locking pin 1376 away as the handle is pivoted towards the locking positions.

The lower base housing 1302 may also include any other useful vacuum cleaner features. For example a light (not shown) may be provided to illuminate the surface being cleaned. The lower base housing 1302 may also have one or more displays 1380, 1382 to provide the user with status information regarding the vacuum cleaner, as known in the art. One or more windows (not shown) may be used to cover and protect the displays 1380, 1382. Of course, these displays 1380, 1382 and other features may be consolidated as a single display, or may be located elsewhere, such as in the upper base housing 1404 (FIG. 14), the grip 112, or the handles 106, 108.

Referring now to FIG. 14, the structure of the base 102 housing is described in detail. The base 102 comprises a number of housing members that are joined to form a generally enclosed assembly. As explained herein, the lower base housing 1302 is used as a structural backbone to hold a large number of the working parts, and the remaining housing members are attached to the top of the lower base housing 1302. Of course, this is just one example of how to assemble the base 102, and other housing arrangements will be apparent to those of ordinary skill in the art in view of the present disclosure and with routine experimentation with embodiments of the invention.

In a preferred embodiment, the inlet nozzle portion of the lower base housing 1302 is covered by a font bumper 1402, which may comprise a rubber or other soft, elastic material, and much of the remainder of the lower base housing 1302 is covered by an upper base housing 1404. Screws, snap engagement, or other fastening devices or methods may be used to hold these and other parts of the housing together. The upper base housing 1404 preferably includes a first opening 1406 that overlies the open top 1326 of the bag chamber 1322, and a second opening 1408 that overlies the motor shroud outlet 1340. The upper base housing 1404 also includes a forward catch 1410, and a rearward catch 1412. One or more gaskets (not shown) may be provided around one or both of the openings 1406, 1408 to provide an airtight seal against the bag chamber 1322 and motor shroud 1332.

A pair of wheel arches 1414 are provided one either side of the base 102 adjacent the wheels 114. The wheel arches 1414 provide a smooth contour between the base 102 and the wheels 114, and the bottom outer edge 1416 of one of the wheel arche 1414 forms a portion of the semi-circular slot 1102 into which the wire bundle 320 passes, as shown in FIGS. 11 and 12. The remaining portions of this slot 1102 are formed by and between the lower and upper base housings 1302, 1404, and the upper base housing 1404 includes a wire bundle hole 1418 through which the wire bundle 320 passes to enter the base 102.

A cover assembly 1420 is provided to releasably attach to the upper base housing 1404. The cover assembly 1420 comprises an outer lid 1422, an inner lid 1424, a vent shroud 1426, and a handle 1428. The inner lid 1424 is attached to a lower, forward portion of the outer lid 1422, and the vent shroud 1426 is attached to the top of the outer lid 1422. The vent shroud 1436 covers a central air passage 1423 in the outer lid 1422 that begins at a rear opening 1425 through the bottom of the outer lid 1422, and ends at the vent shroud 1426 mounting location. The vent shroud 1426 includes a number of holes 1427 or other apertures to allow air to flow through it. In addition, a foam block or additional filter may be located in the central air passage 1423 beneath the vent shroud 1426. The handle 1428 is preferably formed by an upper handle portion 1432 and a lower handle portion 1434. One or both of the handle portions 1432, 1434 may include grip-enhancing features, such as an overmolded rubber layer, dimples, or checkering.

The cover assembly 1420 is selectively attachable to the upper base housing 1404 by inserting a forward tab 1430 on the outer lid 1422 into the forward catch 1410, and a rearward tab 1510 (FIG. 15) on the outer lid 1422 into the rearward catch 1412. When fully installed, the forward tab 1430 contacts the electric cutoff switch 1358, and turns on the power circuit. Once installed, the tabs 1430, 1510 firmly hold the outer lid 1422 against the upper base housing 1404, and preferably firmly enough to use the handle 1428 to safely lift and move the entire vacuum cleaner 100. In a preferred embodiment, the rear tab 1510 comprises a movable tab that is located adjacent the handle 1428, and which can be operated by the same hand that grasps the handle 1428. Of course, other latching arrangements, such as over-center clamps, bayonet fittings, threaded fasteners, snaps, and so on, may be used to hold the cover assembly 1420 to the upper base housing 1404.

Referring now to FIG. 15, when the cover assembly 1420 is installed, the inner lid 1424 covers and seals the bag chamber 1322, either by sealing against the upper base housing 1404, or directly against the open top 1326 of the bag chamber 1322. One or more gaskets or other seals, which are well-known in the art, may be provided to assist with sealing the bag chamber 1322. The rear portion of the cover assembly 1420 overlies the motor shroud outlet 1340, and the post-motor filter 1346 (not shown) installed therein. In this position, the central air passage 1423 through the outer lid 1422 is placed in fluid communication with the downstream side of the post-motor filter 1346. As such, the air exiting the vacuum cleaner passes through the central air passage 1423, and out of the holes 1427 through the vent shroud 1426. One or more seals may be provided to seal the central air passage 1423 to the motor shroud outlet 1340, but this is not required. The airflow through the vacuum cleaner is shown by representative dashed arrows.

The use of a single cover assembly 1420 is preferred because it provides simple and simultaneous access to both the bag chamber 1322 and the post-motor filter 1346, if one is used. In addition, the shape of the cover assembly 1420 and its central air passage 1423 may contribute to noise reduction by providing a relatively circuitous path for the exiting air flow. This exit air flow path is also relatively short, which reduces pressure build-up. The location of the air holes 1427, which direct the exiting air upwards, may also help to prevent the vacuum cleaner exhaust air from scattering dirt and dust on the floor around the vacuum cleaner, and also prevents the air from striking the operator's feet and legs during operation. Despite the expected benefits of these features, alternative constructions, such as one in which two separate covers provided to separately access the bag chamber 1322 and post-motor filter 1346, may alternatively be used with embodiments of the present invention.

While the embodiments described herein are preferred, they are not intended to limit the scope of the invention. Many additional variations of the embodiments described herein will be apparent to those of ordinary skill in the art in view of the present disclosure and with practice of the invention. Furthermore, while various features of the invention have been described as being used together, it will be appreciated that many of these features have separate utility and inventiveness on their own, and are not all required to be used together in every or any embodiment of the invention. As such, the present invention includes embodiments in which the features described herein are used individually or in various other inventive combinations. Such alternative embodiments, modifications and combinations of the various features described herein are within the scope of the present invention, which is limited only by the appended claims.

The invention claimed is:

1. A vacuum cleaner comprising:

a base adapted to be moved on a surface to be cleaned;

an inlet nozzle disposed on a lower surface of the base;

a vacuum source operatively associated with the vacuum cleaner and adapted to draw a working airflow into the inlet nozzle;

a dirt receptacle operatively associated with the vacuum cleaner and adapted to remove dirt from the working airflow;

a lower handle pivotally attached to the base at a lower pivot;

an automatically-operated lower pivot lock including a locking member and a catch, the automatically-operated lower pivot lock having a first lower pivot lock position in which the lower pivot lock restricts relative rotation between the lower handle and the base, and a second lower pivot lock position in which the lower pivot lock does not restrict relative rotation between the lower handle and the base;

an upper handle pivotally attached to the lower handle at an upper pivot; and a manually-operated upper pivot lock including a connecting member operably coupled with the lower pivot lock and a driving member operably coupled with the connecting member, the manually-operated upper pivot lock having a first upper pivot lock position in which the upper pivot lock restricts relative rotation between the upper handle and the lower handle, and a second upper pivot lock position in which the upper pivot lock does not restrict relative rotation between the upper handle and the lower handle;

whereby when the upper handle is manually rotated relative to the lower handle, the driving member moves the connecting member and the connecting member releases the locking member from the catch of the lower pivot lock, thereby automatically allowing rotation of the lower handle relative to the base.

2. The vacuum cleaner of claim 1, wherein the vacuum source is mounted in the base.

3. The vacuum cleaner of claim 1, wherein the dirt receptacle is mounted in the base.

4. The vacuum cleaner of claim 3, wherein the dirt receptacle comprises a bag chamber.

5. The vacuum cleaner of claim 1, wherein the lower pivot lock is operated by rotation of the upper handle relative to the lower handle.

6. The vacuum cleaner of claim 5, wherein the upper pivot lock comprises:

an annular ring having one or more apertures therethrough associated with one of the lower handle and the upper handle; and a movable member associated with the other of the lower handle and the upper handle, the movable member being selectively movable to engage at least one of the one or more apertures to place the upper pivot lock in the first upper pivot lock position, and disengage the one or more apertures to place the upper pivot lock in the second upper pivot lock position.

7. The vacuum cleaner of claim 1, wherein the lower pivot lock comprises a locking rod slidably attached to the lower handle, the locking rod being movable to an extended position in which a lower end of the locking rod can abut a surface on the base to place the lower pivot lock in the first lower pivot lock position, and a retracted position in which the locking rod can not abut a surface on the base to place the lower pivot lock in the second lower pivot lock position.

8. The vacuum cleaner of claim 7, wherein the locking rod comprises an upper end mechanically associated with the upper handle such that the locking rod moves to the retracted position when the upper handle is rotated relative to the lower handle.

9. The vacuum cleaner of claim 8, wherein the locking rod upper end is driven by a cam attached to the upper handle.

10. The vacuum cleaner of claim 1, wherein the lower pivot lock prevents the lower handle from forward rotation beyond a substantially vertical position when the lower pivot lock is in the first lower pivot lock position.

11. The vacuum cleaner of claim 10, wherein the lower pivot lock allows the lower handle to rotate forward up to a substantially vertical position when the lower pivot lock is in the first lower pivot lock position.

12. The vacuum cleaner of claim 1, wherein the upper pivot lock prevents any substantive relative rotation between the upper handle and the lower handle when the upper pivot lock is in the first upper pivot lock position.

13. The vacuum cleaner of claim 1, wherein the lower handle is rotatable in a forward direction relative to the base to generally overlie the base when the lower pivot lock is in the second lower pivot lock position.

14. The vacuum cleaner of claim 13, wherein the upper handle is rotatable in a rearward direction relative to the lower handle to generally overlie the base when the lower handle is rotated forward to overlie the base.

15. The vacuum cleaner of claim 1, wherein the upper handle comprises a telescoping handle assembly.

16. The vacuum cleaner of claim 1, wherein the driving member is a cam, and the connecting member is a follower.

17. A vacuum cleaner comprising:

a base adapted to be moved on a surface to be cleaned;

an inlet nozzle disposed on a lower surface of the base;

a dirt receptacle mounted in the base and in fluid communication with the vacuum inlet;

a vacuum source mounted in the base and adapted to generate a working flow of air into the vacuum inlet and through the dirt receptacle;

a handle pivotally attached to the base, the handle comprising:

a lower handle pivotally attached to the base at a lower pivot;

an upper handle pivotally attached to the lower handle at an upper pivot, the upper handle comprising a lower section, an upper section telescopically mated to the lower section, and an adjustment mechanism adapted to selectively allow and prevent telescopic movement between the upper section and the lower section; and at least one electrical control attached to the upper section of the upper handle, and adapted to control at least one electrical device in the base;

wherein the lower pivot comprises an automatically-operated lower pivot lock including a locking member and a catch, the automatically-operated lower pivot lock having a locked position in which the lower pivot lock restricts at least a portion of the lower handle range of movement, and an unlocked position in which the lower pivot lock does not restrict the portion of the lower handle range of movement;

wherein the upper pivot comprises a manually-operated pivot lock including a connecting member operably coupled with the lower pivot lock and a driving member operably coupled with the connecting member; and whereby when the upper handle is manually rotated relative to the lower handle, the driving member moves the connecting member and the connecting member releases the locking member from the catch of the lower pivot lock, thereby moving the lower pivot lock to the unlocked position, allowing rotation of the lower handle relative to the base.

18. The vacuum cleaner of claim 17, wherein the at least one electrical control comprises a power switch adapted to activate the vacuum source.

19. The vacuum cleaner of claim 17, wherein the at least one electrical control comprises a power switch adapted to activate a brushroll motor.

20. The vacuum cleaner of claim 17, wherein the at least one electrical control is attached to the at least one electrical device by at least one control wire.

21. A vacuum cleaner comprising:

a base adapted to be moved on a surface to be cleaned;

an inlet nozzle disposed on a lower surface of the base;

a dirt receptacle mounted in the base and in fluid communication with the vacuum inlet;

a vacuum source mounted in the base and adapted to generate a working flow of air into the vacuum inlet and through the dirt receptacle;

a handle pivotally attached to the base, the handle comprising:

a lower handle pivotally attached to the base at a lower pivot, and an upper handle pivotally attached to the lower handle at an upper pivot; and an exhaust vent in fluid communication with and downstream of the dirt receptacle and the vacuum source, the exhaust vent being located on an upwardly-facing surface of the base;

wherein the lower pivot comprises an automatically-operated lower pivot lock including a locking member and a catch, the automatically-operated lower pivot lock having a locked position in which the lower pivot lock restricts at least a portion of the lower handle range of movement, and an unlocked position in which the lower pivot lock does not restrict the portion of the lower handle range of movement;

wherein the upper pivot comprises a manually-operated pivot lock including a connecting member operably coupled with the lower pivot lock and a driving member operably coupled with the connecting member; and whereby when the upper handle is manually rotated relative to the lower handle, the driving member moves the connecting member and the connecting member releases the locking member from the catch of the lower pivot lock, thereby moving the lower pivot lock to the unlocked position, allowing rotation of the lower handle relative to the base.

22. The vacuum cleaner of claim 21, wherein the upper handle comprises a lower section, an upper section telescopically mated to the lower section, and an adjustment mechanism adapted to selectively allow and prevent telescopic movement between the upper section and the lower section.

* * * * *